United States Patent [19]

Iijima et al.

[11] Patent Number: 4,701,404

[45] Date of Patent: Oct. 20, 1987

[54] SILVER HALIDE COLOR PHOTOGRAPHIC MATERIAL OF HIGH SENSITIVITY AND IMPROVED GRANULARITY

[75] Inventors: Toshifumi Iijima, Kokubunji; Yoshitaka Yamada, Hino; Kenji Kumashiro, Hachioji; Takashi Kamio, Hachioji; Shinya Shimura, Hachioji, all of Japan

[73] Assignee: Konishiroku Photo Industry Co., Ltd., Japan

[21] Appl. No.: 775,683

[22] Filed: Sep. 13, 1985

[30] Foreign Application Priority Data

Sep. 14, 1984 [JP] Japan ..... 59-193611

[51] Int. Cl.[4] ..... G03C 7/00; G03C 7/26

[52] U.S. Cl. ..... 430/559; 430/503; 430/504; 430/506; 430/509

[58] Field of Search ..... 430/503, 506, 509, 504, 430/559

[56] References Cited

U.S. PATENT DOCUMENTS

| | | | |
|---|---|---|---|
| Re. 29,379 | 8/1977 | Shiba et al. | 430/503 |
| 3,658,536 | 4/1972 | Wolf | 430/506 |
| 3,663,228 | 5/1972 | Wychoff | 430/506 |
| 3,849,138 | 11/1974 | Wyckoff | 430/506 |
| 4,184,876 | 1/1980 | Eeles et al. | 430/505 |
| 4,186,016 | 1/1980 | Lohmann et al. | 430/506 |
| 4,267,264 | 5/1981 | Lohmann et al. | 430/505 |
| 4,444,865 | 4/1984 | Silverman et al. | 430/503 |

FOREIGN PATENT DOCUMENTS

| | | |
|---|---|---|
| 2024441 | 1/1980 | United Kingdom . |
| 2138962 | 10/1984 | United Kingdom . |

*Primary Examiner*—John E. Kittle
*Assistant Examiner*—Mukund J. Shah
*Attorney, Agent, or Firm*—Finnegan, Henderson, Farabow, Garrett & Dunner

[57] ABSTRACT

A silver halide color photographic material having blue-, green- and red-sensitive silver halide emulsion layers coated on a support is provided, each of said layers being composed of a plurality of sub-layers having different sensitivities. In said material, at least a red-sensitive silver halide emulsion sub-layer having high sensitivity is provided between a first green-sensitive silver halide emulsion sub-layer of high sensitivity and a second green-sensitive silver halide emulsion sub-layer having a lower sensitivity than said first green-sensitive sub-layer, said first green-sensitive sub-layer and/or said red-sensitive sub-layer with high sensitivity giving a maximum color density of formed dye in said material higher than 0.6 but not exceeding 1.3.

6 Claims, No Drawings

SILVER HALIDE COLOR PHOTOGRAPHIC MATERIAL OF HIGH SENSITIVITY AND IMPROVED GRANULARITY

FIELD OF THE INVENTION

The present invention relates to a silver halide color photographic material having high sensitivity and being capable of producing an image of good quality. More particularly, the invention relates to a silver halide color photographic material that has not only high sensitivity but also a granularity sufficiently improved to produce a high quality image.

BACKGROUND OF THE INVENTION

With most silver halide color photographic materials, three photographic silver halide emulsion layers spectrally sensitized to blue, green and red light are coated on a support. For example, with silver halide photographic materials for color negatives, a blue-sensitive silver halide emulsion layer on which incident light first falls, a green-sensitive silver halide emulsion layer, and a red-sensitive silver halide emulsion layer are coated on a support in that order. Usually, a bleachable yellow filter is disposed between the blue- and green-sensitive emulsion layers so as to absorb any of the blue light that has passed through the blue-sensitive layer. Other intermediate layers having various functions are placed between each emulsion layer, and a protective layer is provided as the outermost layer. It is known to arrange the respective light-sensitive emulsion layers in different orders than shown above. It is also known to use a light-sensitive silver halide emulsion layer unit that consists of two layers that are sensitive to substantially the same wavelength region but which have different sensitivities. These silver halide color photographic materials use aromatic primary amine compounds as typical color developing agents, which develop exposed silver halide grains so that the oxidation product of the developing agent reacts with a dye forming coupler to form the desired dye image. In this method of color development, different couplers are used to form cyan, magenta and yellow dye images: cyan couplers are those based on phenols and naphthols; magenta couplers are based 5-pyrazolone, pyrazolinobenzimidazole, pyrazolotriazole, indazolone and cyanoacetyl compounds; and yellow couplers are based on acylacetamides. These dye forming couplers are incorporated in either the appropriate light-sensitive silver halide emulsion layers or a developing solution. The photographic material contemplated by the present invention may be of either type, but in a preferred embodiment, the couplers are rendered non-diffusible by incorporation in silver halide emulsion layers.

Recently, in the photographic industry, there has been an increasing demand for silver halide color photographic materials that have high sensitivity and which are capable of producing an image of high quality. One reason for this demand is the increasing desire to take pictures under less favorable conditions such as insufficient light (e.g. shooting indoors) and use of telephoto lens or zoom lens which are subject to accidental movement because of their heavy weight. Secondly, the consumer's preference for small formats has obviously given incentives to the development of silver halide color photographic materials that not only have high density but also produce images of good quality in terms of sharpness, granularity and interimage effect.

However, higher sensitivity and better image are two requirements that are difficult to satisfy at the same time. First, with respect to the usual layer arrangement wherein red-, green- and blue-sensitive silver halide emulsion layers are coated in sequence on a support, with the red-sensitive layer lying closest to the support, it has been proposed that higher sensitivity can be obtained by modifying part or all of the light-sensitive silver halide emulsion layers in such a manner that a certain emulsion layer is divided into two layers having sensitivity to substantially the same color of light and placed one immediately above the other, one being a layer of higher sensitivity and the other of lower sensitivity, and each containing non-diffusible couplers that will develop substantially the same color.

Two problems are noticeable in this layer arrangement: firstly, the light-sensitive silver halide emulsion layer positioned closer to the support receives an insufficient amount of incident light for exposure since the greater part of light is absorbed by the other light-sensitive emulsion layers which are farther from the support; secondly, the developing solution takes a longer time to reach the emulsion layers positioned closer to the support. Because of this insufficient exposure and retarded development, the green- and red-sensitive silver halide emulsion layers which are closer to the support than the blue-sensitive layer are not completely adapted to the achievement of higher sensitivity.

Layer arrangements that are modifications of the above described usual arrangement are also known. For example, U.S. Pat. No. 3,663,228 discloses the following two-unit structure, wherein:

(a) red-, green- and blue-sensitive silver halide emulsion layers of lower sensitivity are coated on a support, with the red-sensitive layer closest to the support, so as to make an RGB lower-sensitivity layer unit (said RGB denote red, green and blue, respectively; hereinafter the same.);

(b) on said RGB lower-sensitivity layer unit, red-, green- and blue-sensitive silver halide emulsion layers of higher sensitivity are coated, with the red-sensitive layer closest to the support, so as to make an RGB higher-sensitivity layer unit.

According to U.S. Pat. No. 3,663,228, the RGB higher-sensitivity layer unit is isolated from the RGB lower-sensitivity layer unit by a neutral density (ND) filter. The use of this ND filter clearly shows that the achievement of higher sensitivity is not at all contemplated by the invention of said U.S. patent. In addition, the performance of the claimed two-unit structure falls short of satisfying the requirements for high quality.

A green-sensitive silver halide emulsion layer has significant effects on spectral luminous efficiency, and U.S. Pat. No. 3,658,536 discloses a technique for counteracting the insufficiency of exposure given to this green-sensitive layer by providing it in a position farther from the support. This alteration of layer arrangement, however, is not sufficient to provide better granularity.

The followings techniques have been proposed as modified layer arrangements capable of achieving higher sensitivity.

(A) Unexamined Published Japanese Patent Application No. 49027/1976 discloses a structure wherein:

(a) red- and green-sensitive silver halide emulsion layers of lower sensitivity are coated on a support, with the red-sensitive layer closer to the support, so as to make an RG lower-sensitivity layer unit;

(b) on said RG lower-sensitivity layer unit, red- and green-sensitive silver halide emulsion layers of higher sensitivity are coated, with the red-sensitive layer closer to the support, so as to make an RG higher-sensitivity layer unit;

(c) on said RG higher-sensitivity layer unit, two blue-sensitive silver halide emulsion layers, one having the higher sensitivity and the other having the lower sensitivity, are coated as in the usual layer arrangement to provide a B unit.

(B) Unexamined Published Japanese Patent Application No. 97424/1978 discloses a silver halide color photographic material having the same layer arrangement as in (A) except that each of the red- and blue-sensitive silver halide emulsion layers in the RG lower-sensitivity layer unit is divided into two layers, one having a medium sensitivity and the other having a low sensitivity.

(C) Japanese Patent Application No. 52115/1983 filed by the applicant of subject application proposes a structure wherein an RGB higher-sensitivity layer unit and an RGB lower-sensitivity layer unit are coated in sequence on a support.

The silver halide color photographic materials with the layer arrangements (A), (B) and (C) are common in that at least a red-sensitive silver halide emulsion layer having high sensitivity is disposed between a green-sensitive silver halide emulsion layer of high sensitivity and a green-sensitive layer having a lower sensitivity than the first green-sensitive emulsion layer. These arrangements are effective in achieving the objectives of obtaining a higher sensitivity and better image quality but are still insufficient to satisfy the recent requirements for providing images of super-high quality.

SUMMARY OF THE INVENTION

The primary object, therefore, of the present invention is to provide a silver halide color photographic material that has high sensitivity and which produces an image of further improved quality.

This object can be achieved by a silver halide color photographic material having blue-, green- and red-sensitive silver halide emulsion layers coated on a support, each layer being composed of a plurality of sub-layers having different sensitivities, wherein at least a red-sensitive silver halide emulsion sub-layer having high sensitivity is provided between a first green-sensitive silver halide emulsion sub-layer of high sensitivity and a second green-sensitive silver halide emulsion sub-layer having a lower sensitivity than said first green-sensitive sub-layer, said first green-sensitive sub-layer and/or said red-sensitive sub-layer with high sensitivity giving a maximum color density of formed dye in said material higher than 0.6 but not exceeding 1.3.

PREFERRED EMBODIMENTS OF THE INVENTION

The term "sub-layer of high sensitivity" means the sub-layer having the highest sensitivity of two silver halide emulsion sub-layers that are sensitive to light of the same color. On the other hand, the term "sub-layer of low sensitivity" means the sub-layer having the lowest sensitivity.

In the silver halide color photographic material of the present invention, the sensitivity difference between the emulsion layer of high sensitivity and that of low sensitivity is preferably in the range of 0.2 to 2.0 log E units (E: exposure) in consideration of granularity and gradation. The more preferred range is from 0.4 to 1.2. If an emulsion layer of medium sensitivity is provided, the sensitivity difference between this layer and the layer of high sensitivity is preferably in the range of 0.2 to 1.5 log E units, with the range of 0.4 to 1.0 being more preferred. The sensitivity difference between the emulsion layer of medium sensitivity and the layer of low sensitivity is preferably in the range of 0.1 to 1.0 log E unit.

The silver halide color photographic material of the present invention has a wide exposure latitude and has been found to produce a good image quality, particularly in terms of granularity, over that exposure scale. The inventors have many years of experience in the studies of photography but even to them, it was entirely unexpected that the concept of the present invention led not only to higher sensitivities but also to the production of good image quality over an extended exposure latitude.

It has heretofore been proposed that image quality can be improved by using water-soluble dyes or halation colloids, but these techniques involve one serious defect, ie, a considerable degree of desensitization occurs. It is therefore quite surprising that the present invention should achieve an improved image quality without causing any desensitization.

The layer arrangement of the silver halide color photographic material in accordance with the invention is hereunder described. Basically, it has blue-, green- and red-sensitive silver halide emulsion layers formed on a support, each consisting of a plurality of sub-layers having different sensitivities. It suffices that at least a red-sensitive silver halide emulsion sub-layer of high sensitivity is provided between a first green-sensitive silver halide emulsion sub-layer of high sensitivity and a second green-sensitive silver halide emulsion sub-layer having a lower sensitivity than said first green-sensitive sub-layer.

(I) One group of typical embodiments of the layer arrangement in accordance with the present invention are described below.

(1) A structure wherein a support is coated with an RG lower-sensitivity layer unit, which is overlaid in sequence with an RG higher-sensitivity layer unit and a B high-and-low sensitivity layer unit.

(2) A structure which is the same as structure (1) except that the position of the red-sensitive silver halide emulsion layer of low sensitivity (RL) relative to the green-sensitive silver halide emulsion layer of low sensitivity (GL) is opposite to the relative position in (1).

(3) A structure which is the same as structure (1) or (2) except that the red-sensitive silver halide emulsion layer of low sensitivity (RL) is divided into two sub-layers, one having a medium sensitivity (RM) and the other having a low sensitivity (Rl).

(4) A structure which is the same as structure (1) or (2) except that the green-sensitive silver halide emulsion layer of low sensitivity (GL) is divided into two sub-layers, one having a medium sensitivity (GM) and the other having a low sensitivity (Gl).

(5) A structure which is the combination of structures (3) and (4).

(6) A structure according to any one of structures (1) to (5) wherein a non-sensitive hydrophilic colloidal layer (or intermediate layer, IL) is provided in at least one of the following positions, ie, between the red-sensitive silver halide emulsion layer of low sensitivity (RL)

and the green-sensitive silver halide emulsion layer of low sensitivity (GL), between the green-sensitive silver halide emulsion layer of low sensitivity (GL) and the red-sensitive silver halide emulsion layer of high sensitivity (RH), between the red-sensitive silver halide emulsion layer of high sensitivity (RH) and the green-sensitive silver halide emulsion layer of high sensitivity (GH), and between the green-sensitive silver halide emulsion layer of high sensitivity (GH) and the blue-sensitive silver halide emulsion layer of low sensitivity (BL).

(7) A structure which is the same as structure (6) except that a yellow filter layer (YF) is provided as an intermediate layer which is closer to the support and is adjacent the blue-sensitive silver halide emulsion layer of low sensitivity (BL) and/or as an intermediate layer which is closer to the support and is adjacent said RG higher-sensitivity layer unit or GR higher-sensitivity layer unit.

(8) A structure which is the same as structure (6) except that at least one of the intermediate layers contains a scavenger (a material that prevents the oxidation product of a color developing agent from diffusing into any silver halide emulsion layer having sensitivity to light of a different color).

(9) A structure according to any of structures (1) to (8) which further contains a subbing layer, a protective layer (Pro) or any other intermediate layers (e.g. ultraviolet absorbing layer, anti-halation layer, etc.).

(II) Another group of typical embodiments of the layer arrangement in accordance with the present invention are described below.

(1) A structure wherein a support is coated with an RGB lower-sensitivity layer unit, which is overlaid with an RGB higher-sensitivity layer unit.

(2) A structure which is the same as structure (1) except that the position of the red-sensitive silver halide emulsion layer of low sensitivity (RL) relative to the green-sensitive silver halide emulsion layer of low sensitivity (GL) is opposite to the relative position in (1).

(3) A structure which is the same as structure (1) or (2) except that the red-sensitive silver halide emulsion layer of low sensitivity (RL) is divided into two sub-layers, one having a medium sensitivity (RM) and the other having low sensitivity (Rl); the same provision applies to the green-sensitive silver halide emulsion layer of low sensitivity (GL) which may be divided into two sub-layers, one having a medium sensitivity (GM) and the other having low sensitivity (Gl).

(4) A structure according to any one of structures (1) to (3) wherein a non-sensitive hydrophilic colloidal layer (or intermediate layer, IL) is provided in at least one of the following positions, i.e., between the red-sensitive silver halide emulsion layer of low sensitivity (RL) and the green-sensitive silver halide emulsion layer of low sensitivity (GL), between the green-sensitive silver halide emulsion layer of low sensitivity (GL) and the blue-sensitive silver halide emulsion layer of low sensitivity (BL), the blue-sensitive silver halide emulsion layer of low sensitivity (BL) and the red-sensitive silver halide emulsion layer of high sensitivity (RH), between the red-sensitive silver halide emulsion layer of high sensitivity (RH) and the green-sensitive silver halide emulsion layer of high sensitivity (GH), and between the green-sensitive silver halide emulsion layer of high sensitivity (GH) and the blue-sensitive silver halide emulsion layer of high sensitivity (BH).

(5) A structure which is the same as structure (4) wherein the intermediate layer between the green-sensitive silver halide emulsion layer of low sensitivity (GL) and the blue-sensitive silver halide emulsion layer of low sensitivity (BL) and/or the intermediate layer between the green-sensitive silver halide emulsion layer of high sensitivity (GH) and the blue-sensitive silver halide emulsion layer of high sensitivity (BH) is a yellow filter layer (YF).

(6) A structure which is the same as structure (4) except that at least one of the intermediate layers contains a scavenger (a material the prevenets the oxidation product of a color developing agent from diffusing into any silver halide emulsion layer having sensitivity to light of a different color).

(7) A structure according to any of structures (1) to (6) which further contains a subbing layer, a protective layer (Pro) or any other intermediate layers (e.g. ultraviolet absorbing layer, anti-halation layer, etc.).

Of the two sets of embodiments (1) and (2), the latter is preferred.

As shown in Japanese Patent Application No. 50571/1984, fine grained non-sensitive silver halide may be incorporated in the blue-sensitive silver halide emulsion layer of high sensitivity (BH) and/or a colloidal layer adjacent said blue-sensitive layer. The fine grains of silver halide are preferably mono-dispersed with an average size of 0.5–0.03 $\mu$m. A preferred silver halide is silver iodobromide.

The silver halide color photographic material of the present invention having the modified layer arrangement described above is further characterized by the fact that the green-sensitive silver halide emulsion layer of high sensitivity (GH) and/or the red-sensitive silver halide emulsion layer of high sensitivity (RH) has a maximum color density higher than 0.6 but not exceeding 1.3. The maximum color density is an optical density as measured with green light for the green-sensitive silver halide emulsion layer and by red light for the red-sensitive silver halide emulsion layer. The maximum color density of formed dye is one obtained after color development that follows imagewise exposure of the silver halide color photographic material of the present invention. The term "color development" includes not only processing with a color developer but also processing with an alkali solution when the color developing agent described above is incorporated within the silver halide color photographic material. If the maximum color density as defined above is 0.6 or below, no granularity improvement is obtained in gradation regions softer than halftone. If the maximum density exceeds 1.3, the granularity in the tone region is degraded. Therefore, the object of the present invention is not attained unless the maximum color density of the green-sensitive silver halide emulsion layer of high sensitivity (GH) and/or the red-sensitive silver halide emulsion layer of high sensitivity (RH) is less than 0.6 and not higher than 1.3. In order to achieve the object of the invention more effectively, the maximum color density is preferably in the range of 0.7 to 1.2, more preferably in the range of 0.8–1.1

While the maximum color density of the green-sensitive silver halide emulsion layer of high sensitivity (GH) and/or the red-sensitive silver halide emulsion layer of high sensitivity (RH) is controlled to be within the range shown above, it is preferred that that the sum of the maximum color density of each layer and that of the corresponding emulsion layer of low sensitivity, GL or RL, that is sensitive to light of the same color is 2.3 or higher but not higher than 6. The same applies to the blue-sensitive silver halide emulsion of high sensitivity (BH) and the blue-sensitive emulsion layer of low sensitivity (BL).

The maximum color density of the blue-sensitive silver halide emulsion layer of high sensitivity (BH) used in the present invention is not critical but it is, preferably more than 0.6 and not exceeding 1.60. The particularly preferred range is from 0.70 to 1.30.

The silver halide incorporated in the green-sensitive silver halide emulsion layer of high sensitivity (GH) and/or the red-sensitive silver halide emulsion layer of high sensitivity (RH) used in the present invention preferably has a mean grain size of 0.40–3.00 μm, with the range of 0.50–2.50 μm being more preferred.

The silver halide incorporated in the green-sensitive silver halide emulsion layer of low sensitivity (GL) and/or the red-sensitive silver halide emulsion layer of low sensitivity (RL) used in the present invention preferably has a mean grain size of 0.20–1.50 μm, with the range of 0.20–1.00 μm being more preferred. If the green-sensitive silver halide emulsion layer of low sensitivity (GL) and/or the red-sensitive silver halide emulsion layer of low sensitivity (RL) is divided into two sub-layers, one having a medium sensitivity and the other having low sensitivity, the silver halide in the former sub-layer preferably has a mean grain size of 0.30–1.50 μm while that for the latter sub-layer is preferably in the range of 0.15–1.00 μm. Each of the low-sensitivity sub-layers may incorporate a mixture of two or more silver halide emulsions having different mean grain sizes.

The mean grain sizes of the silver halides incorporated in the light-sensitive silver halide emulsion layers used in the present invention may be measured by a variety of methods commonly used in the art. Typical methods are described by R. P. Love-land in "Particle Size Analysis", ASTM Symposium on Light Microscopy, pp. 94–122, 1955, and C. E. K. Mees and T. H. James, "Theory of the Photographic Process", 3rd ed., Chapter 2, Macmillan Publishing Co., Inc., 1966. These grain sizes are expressed in terms of the projected area or as "diameters of equivalent circles". If the particles are substantially uniform in geometrical forms, their size distribution can be expressed fairly accurately in terms of diameter or projected area.

The silver halide emulsions used in the present invention may be poly-dispersed wherein their grain sizes are distributed over a broad range, but more preferably, the emulsions are mono-dispersed.

The silver halide grains in the green-sensitive silver halide emulsion layer and/or the red-sensitive silver halide emulsion layer used in the present invention are regarded as being monodispersed if most of the grains are uniform in their geometrical form and size as observed under an electron microscope and if the grains have such a size distribution that the standard deviation of size distribution, s, as divided by the mean particle size, $\bar{r}$, is 0.20 or below, preferably 0.15 or below:

$$s = \sqrt{\frac{\Sigma(\bar{r} - ri)^2 ni}{\Sigma ni}}$$

$$\frac{s}{\bar{r}} \leqq 0.20 \text{ (preferably 0.15).}$$

The term "particle size" has the same meaning as defined for the mean grain size; it represents the diameter of spherical silver halide grains, and if the grains are cubic or in other non-spherical forms, the particle size is expressed in terms of the diameter of a circle having the same area as that of the projected image of a given particle. The grain size of an individual particle in this sense of the term is denoted by ri, and if the total number of grains of interest is represented by ni, $\bar{r}$ is defined by the following equation:

$$\bar{r} = \frac{\Sigma ni \cdot ri}{\Sigma ni}.$$

The grain size distribution may be determined by the method described by A. P. H. Trivelli and W. F. Smith in their article, Empirical Relationship Between Sensitometric Distribution and Grain Size Distribution in Photography", The Photographic Journal, LXXIX, pp. 330–338, 1948.

In a preferred embodiment of the present invention, a mixture of two or more monodispersed silver halide grains may be incorporated in at least one of the blue-, green- and red-sensitive silver halide emulsion layers of high sensitivity defined in the invention. In this case, the individual silver halide grains may have the same or different average particle sizes. Polydispersed silver halide grains may be used in combination with the monodispersed grains to an extent that will not compromise the object of the present invention.

The silver halides incorporated in the green- and red-sensitive silver halide emulsion layers may be silver iodobromide, silver chlorobromide, silver bromide, silver chloride, silver chloroiodobromide or mixtures thereof. The preferred silver halide is silver iodobromide, in which silver iodide is preferably present in an amount not exceeding 8 mol%.

As in the case of the green- and red-sensitive silver halide emulsion layers of high sensitivity (GH and RH), the silver halide incorporated in the blue-sensitive silver halide emulsion layer of high sensitivity (BH) is preferably monodispersed.

The composition of the silver halide in the blue-sensitive silver halide emulsion layer is not limited to any particular type and may be silver chloride, silver bromide, silver chlorobromide, silver chloroiodobromide or mixtures thereof. The preferred composition is silver iodobromide, in which silver iodide is preferably present in an amount not less than 4 mol%.

The average grain size of the silver halide present in the blue-sensitive silver halide emulsion layer is not limited to any particular value. Generally, the silver halide in the blue-sensitive silver halide emulsion layer of high sensitivity (BH) ranges from 0.40 to 3.00 μm, preferably from 0.50 to 2.50 μm, while the silver halide in the blue-sensitive silver halide emulsion layer of low sensitivity (BL) preferably ranges from 0.20 to 1.50 μm.

In the silver halide color photographic material of the present invention, each of the blue-, green- and red-sensitive silver halide emulsion layers of high sensitivity (BH, GH and RH) preferably has a silver content (as silver deposit) of 0.5–3 g/m$^2$, with the range of 1–2.5 g/m$^2$ being more preferred. Each of the blue-, green- and red-sensitive silver halide emulsion layers of low sensitivity (BL, GL and RL) preferably has a silver content (as silver deposit) of 0.5–3 g/m$^2$, with the range of 1–2.5 g/m$^2$ being more preferred. Simply stated, the silver content in each of the emulsion layers, whether they have high or low sensitivity, is preferably not more than 3 g/m$^2$ in order to provide good image quality. On the other hand, in order to obtain high maximum density and sensitivity, the silver content in each of these emulsion layers is preferably 0.5 g/m$^2$ or higher.

The silver halide grains used in the present invention may be normal crystals, twins or any other crystals, and they may have any proportions of (100) and (111) planes. These silver halide grains may have a homogeneous structure throughout the crystal, or they may have a core-shell structure wherein the interior the crystal has a different structure from that of the surface layer. These silver halide grains may be of the surface type where latent images are predominantly formed on the grain surface or of the internal type where latent images are formed within the grain. With grains of a core-shell structure, the silver iodide content of the core is preferably higher than that of the shell.

The silver halide grains used in the present invention may be prepared by the neutral method, ammoniacal method or acid method.

Alternatively, seed grains may be first prepared by the acid method and then the seeds are subsequently grown to a predetermined size by the faster ammoniacal method. During the growth of silver halide grains, the pH, pAg and other factors in the reactor and controlled and, as shown in Unexamined Published Japanese Patent Application No. 48521/1979, silver and halide ions are consecutively or simultaneously added in amounts that are in agreement with the rate of the growth of silver halide grains.

The silver halide grains in accordance with the present invention are prepared by the procedures described above, and a composition containing the thus prepared silver halide grains is referred to as a silver halide emulsion in this specification.

These silver halide emulsions may be chemically sensitized with a variety of sensitizers such as sulfur sensitizers (e.g. arylthiocarbamide, thiourea and crystine); selenium sensitizers; reduction sensitizers (e.g. stannous salts, thiourea dioxide and polyamines); noble metals sensitizers (e.g. gold sensitizers illustrated by potassium aurithiocyanate, potassium chloroaurate and 2-aurothio-3-methylbenzothiazolium chloride) and sensitizers made of water-soluble salts of ruthenium, palladium, platinum, rhodium or iridium (e.g. ammonium chloropalladate, potassium chloroplatinate and sodium chloropalladate, some of which may act as sensitizers or fog inhibitors depending on their amount). These sensitizers may be used either independently or in combination (e.g. the combination of a gold sensitizer and sulfur sensitizer, or the combination of a gold sensitizer and selenium sensitizer).

The silver halide emulsions in accordance with the present invention are chemically ripened by addition of sulfur-containing compounds, and before, during or after this chemical ripening, at least one hydroxytetrazaindene and at least one nietrogen-containing heterocyclic compound having a mercapto group may be incorporated in the emulsions.

In order to provide sensitivity for the desired spectral wavelength regions, the silver halides used in the present invention may be optically sensitized by suitable sensitizing dyes that are added in amounts ranging from $5\times10^{-8}$ to $3\times10^{-3}$ moles per mole of the silver halide. A variety of sensitizing dyes may be used either individually or in combination. The following sensitizing dyes may be used with advantage in the present invention.

Illustrative sensitizing dyes that may be used with the blue-sensitive silver halide emulsions are shown in West German Pat. No. 929,080, U.S. Pat. Nos. 2,231,658, 2,493,748, 2,503,776, 2,519,001, 2,912,329, 3,656,959, 3,672,897, 3,694,217, 4,025,349, and 4,046,572; British Pat. No. 1,242,588; and Japanese Patent Publication Nos. 14030/1969 and 24844/1977. Typical examples of the sensitizing dyes that may be used with the green-sensitive silver halide emulsion are cyanine, merocyanine and complex cyanine dyes of the types described in U.S. Pat. Nos. 1,939,201, 2,072,908, 2,739,149 and 2,945,763; and British Pat. No. 505,979. Typical examples of the sensitizing dyes that may be used with the red-sensitive silver halide emulsion are cyanine, merocyanine and complex cyanine dyes of the types described in U.S. Pat. Nos. 2,269,234, 2,270,378, 2,442,710, 2,454,629 and 2,776,280. Cyanine, merocyanine and complex cyanine dyes of the types described in U.S. Pat. Nos. 2,213,995, 2,493,748, and 2,519,001; and West German Pat. No. 929,080 may also be used advantageously with the green or red-sensitive silver halide emulsion. The sensitizing dyes listed above may be used either singly or in combination.

If desired, the photographic material of the present invention may be optically sensitized to the desired wavelength regions by spectral sensitization using cyanine or merocyanine dyes either singly or in combination.

Typical examples of the particularly preferred spectral sensitization method include the following (1): spectral sensitization using the combination of benzimidazolocarbocyanine and benzoxazolocarbocyanine, such as disclosed in Japanese Patent Publication Nos. 4936/1968, 22884/1968, 18433/1970, 37443/1972, 28293/1973, 6209/1974 and 12375/1978; and Unexamined Published Japanese Patent Application Nos. 23931/1977, 51932/1977, 80118/1979, 153926/1983, 116646/1984 and 116647/1984; (2) spectral sensitization using the combinations of carbocyanine having a benzimidazole nucleus with other cyanine or merocyanine dyes, such as disclosed in Japanese Patent Publication Nos. 25831/1970, 11114/1972, 25379/1972, 38406/1973, 38407/1973, 34535/1979 and 1569/1980; and Unexamined Published Japanese Patent Application Nos. 33220/1975, 38526/1975, 107127/1976, 115820/1976, 135528/1976, 104916/1977 and 104917/1977; (3) spectral sensitization using the combinations of benzoxazolocarbocyanine (oxacarbocyanine) and other carbocyanines, such as described in Japanese Patent Publication Nos. 32753/1969 and 11627/1971; and Unexamined Published Japanese Patent Application No. 1483/1982; (4) spectral sensitization using merocyanine dyes, such as disclosed in Japanese Patent Publication Nos. 38408/1973, 41204/1973 and 40662/1975; and Unexamined Published Japanese Patent Application Nos. 25728/1981, 10753/1973, 91445/1983, 116645/1984 and 33828/1975; (5) spectral sensitization using the combinations of thiacarbocyanine and other carbocyanines, such as described in Japanese Patent Publication Nos. 4932/1968, 4933/1968, 26470/1970, 18107/1971 and 8741/1972; and Unexamined Published Japanese Patent Application No. 114533/1984; and (6) spectral sensitization using the combination of zeromethine or dimethine merocyanine, monomethine or trimethine cyanine and styryl dyes, as shown in Japanese Patent Publication No. 6207/1974.

The sensitizing dyes listed above are added to the silver halide emulsions of the present invention in the form of dye solutions after they are dissolved in such hydrophilic organic solvents as methyl alcohol, ethyl alcohol, acetone, dimethylformamide, and alcohol fluoride which is described in Japanese Patent Publication No. 40659/1975.

The sensitizing dyes may be added to the silver halide emulsions before, during or after the chemical ripening of the latter. If desired, the dyes may be added just before the step of emulsion coating.

The silver halide color photographic material of the present invention may incorporate in a hydrophilic colloidal layer water-soluble dyes either as filter dyes or for other various purposes such as for protection against irradiation. Suitable dyes that can be used for such purposes include oxonal dyes, hemioxonal dyes, merocyanine dyes, and azo dyes. Oxonal dyes, hemioxonal dyes and merocyanine dyes are particularly useful. Specific examples of the usable dyes are described in British Pat. Nos. 584,609, and 1,277,429; Unexamined Published Japanese Patent Application Nos. 85130/1973, 99620/1974, 114420/1974, 129537/1974, 108115/1977 and 25845/1984; and U.S. Pat. Nos. 2,274,782, 2,533,472, 2,956,879, 3,125,448, 3,148,187, 3,177,078, 3,247,127, 3,540,887, 3,575,704, 3,653,905, 3,718,472, 4,071,312 and 4,070,352.

The silver halide emulsion layers and other photographic layers in the photographic material of the present invention may incorporate couplers, or compounds that are capable of reacting with the oxidation product of a color developing agent to form specific dyes.

Ordinary colored magenta couplers may be used in the green-sensitive silver halide emulsion layer of the present invention. Usable colored magenta couplers are shown in U.S. Pat. Nos. 2,801,171 and 3,519,429; and Japanese Patent Publication No. 27930/1973.

Particularly preferred colored magenta couplers are listed below:

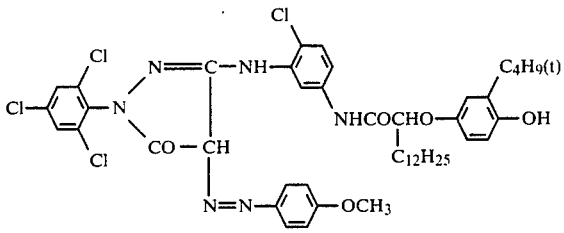

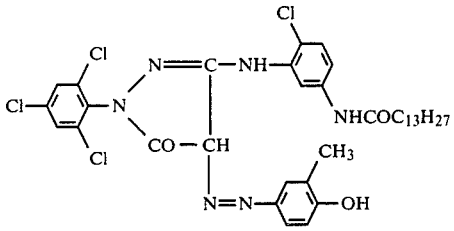

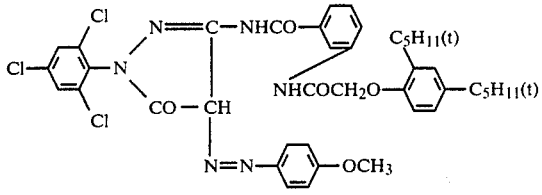

-continued

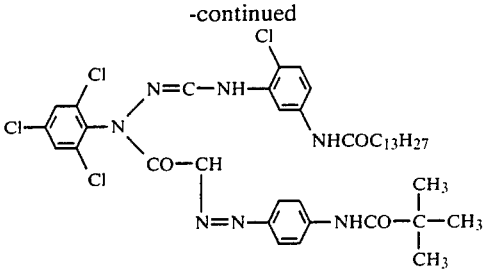

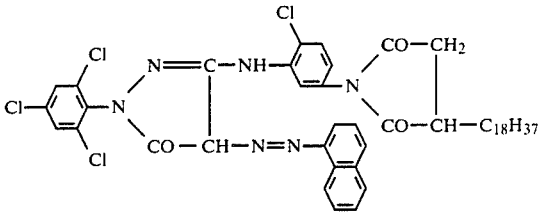

Ordinary colored cyan couplers may be used in the red-sensitive silver halide emulsion layer of the present invention. Usable colored cyan couplers are shown in Japanese Patent Publication No. 32461/1980 and British Pat. No. 1,084,480.

Particularly preferred colored cyan couplers are listed below:

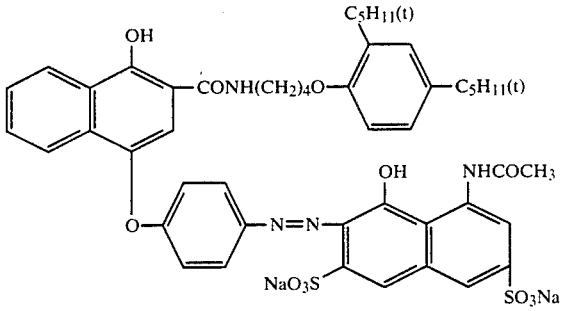

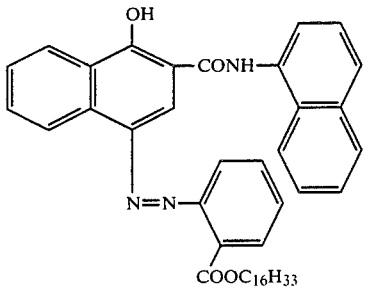

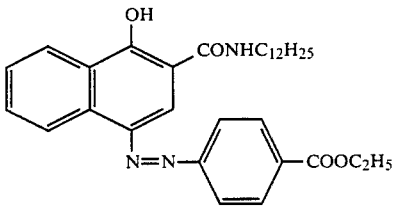

The light-sensitive emulsion layers in the photographic material of the present invention may incorporate couplers that develop the corresponding colors.

It is generally preferred that yellow dye forming couplers are contained in the blue-sensitive layer of the invention, and known open-chain ketomethylene couplers may be used as yellow dye forming couplers. Benzoylacetanilide and pivaloyl acetanilide compounds are used with particular advantage.

Specific examples of the yellow color couplers are described in Unexamined Published Japanese Patent Application Nos. 26133/1972, 29432/1973, 87650/1975, 17438/1976, and 102636/1976; Japanese Patent Publication No. 19956/1970; U.S. Pat. Nos. 2,875,057, 3,408,194 and 3,519,429; and Japanese Patent Publication Nos. 33410/1976, 10783/1976 and 19031/1981.

Particularly preferred yellow color couplers are listed below:

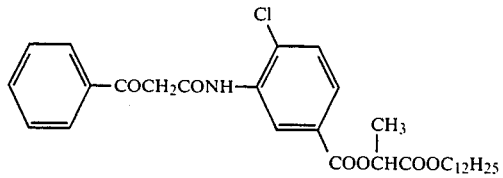

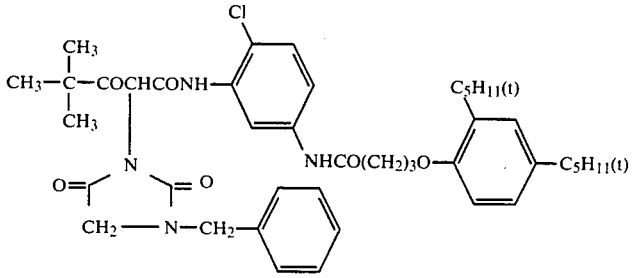

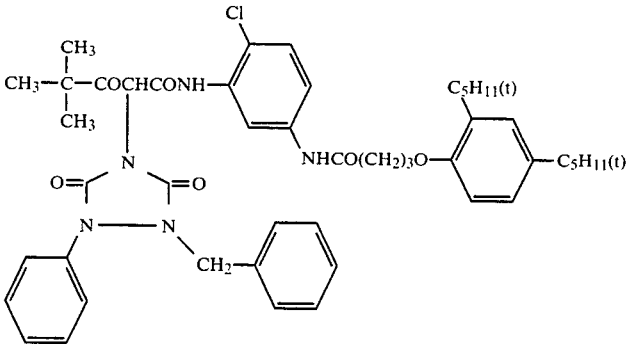

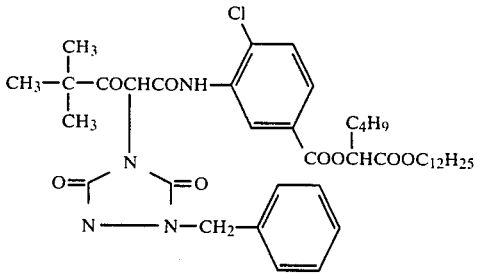

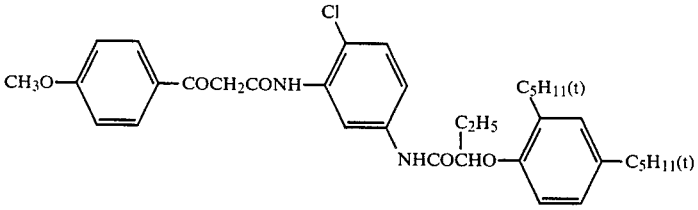

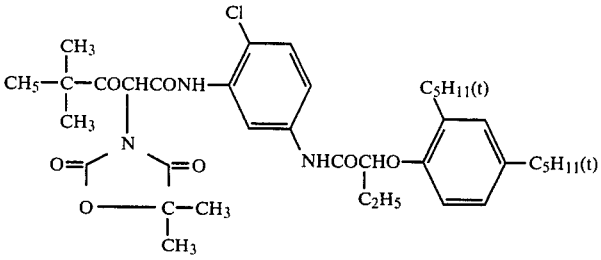

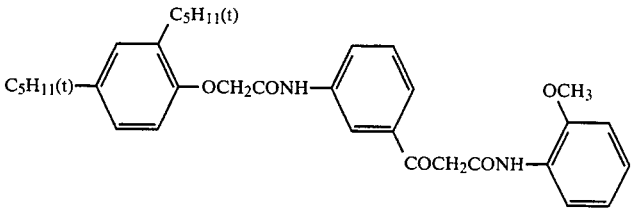

-continued
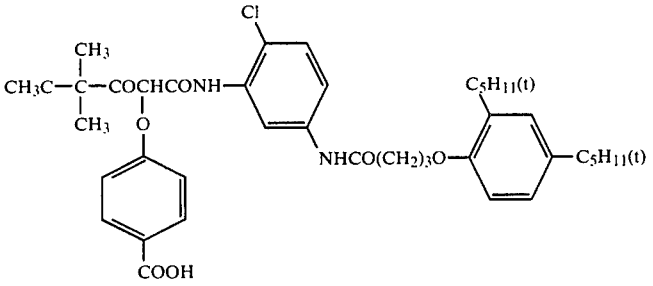
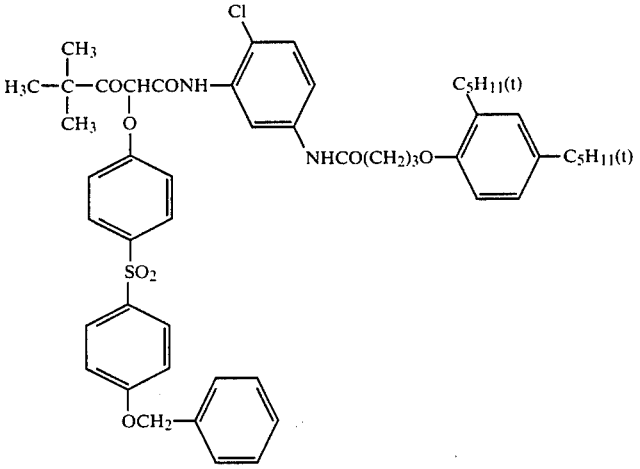
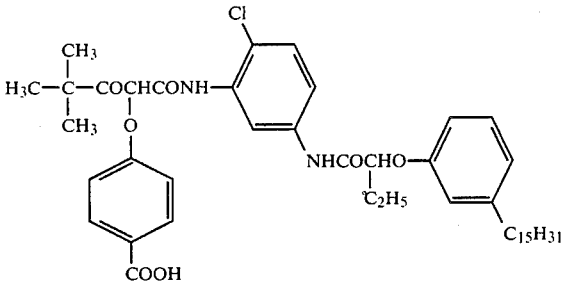
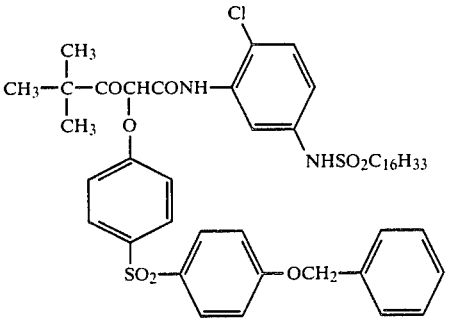
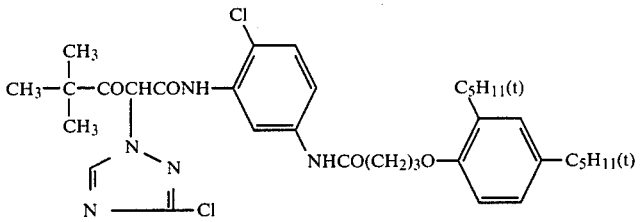
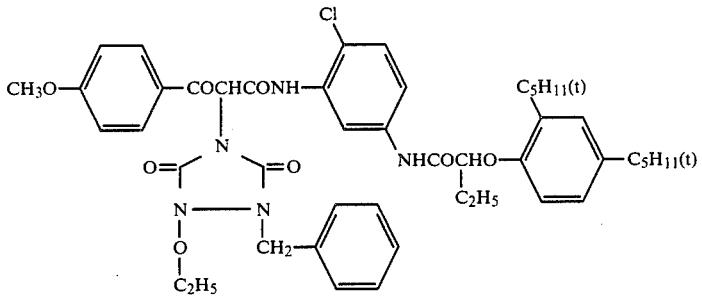

-continued

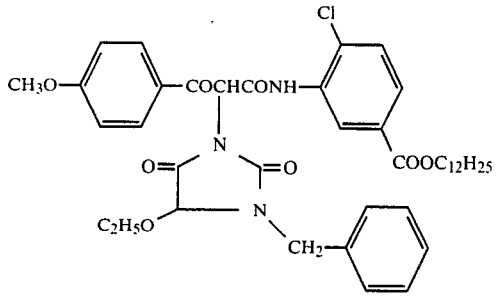

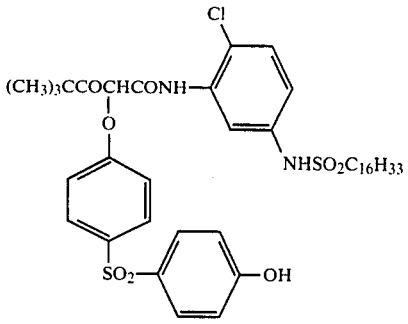

Magenta color couplers that may be used in the photographic material of the present invention include pyrazolone, indazolone, cyanoacetyl and pyrazolotriazole compounds, and pyrazolone compounds are used with particular advantage.

Specific examples of the usable magenta color couplers are shown in Unexamined Published Japanese Patent Application No. 111631/1974; Japanese Patent Publication No. 27930/1973; Unexamined Published Japanese Patent Application No. 29236/1981; U.S. Pat. Nos. 2,600,788, 3,062,653, 3,408,194 and 3,519,429; Unexamined Published Japanese Patent Application No. 94752/1982; and Research Disclosure No. 12443.

Particularly preferred magenta color couplers are listed below:

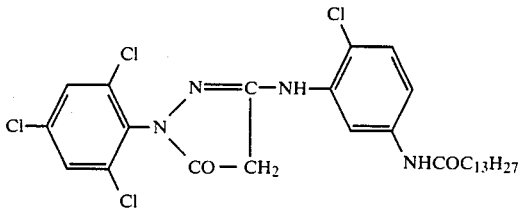

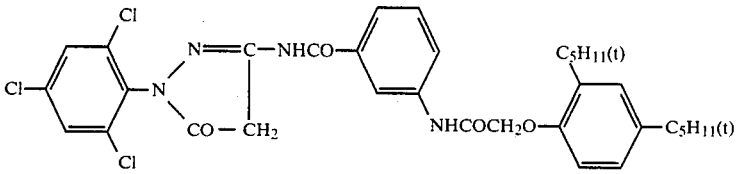

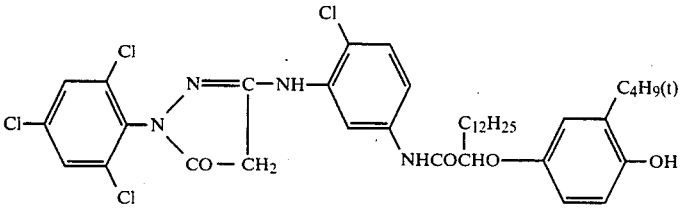

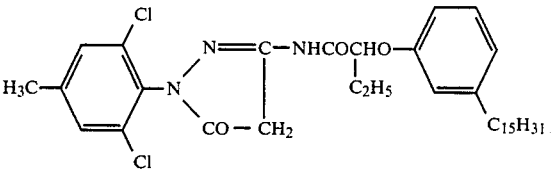

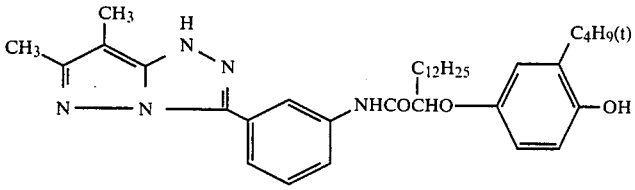

-continued
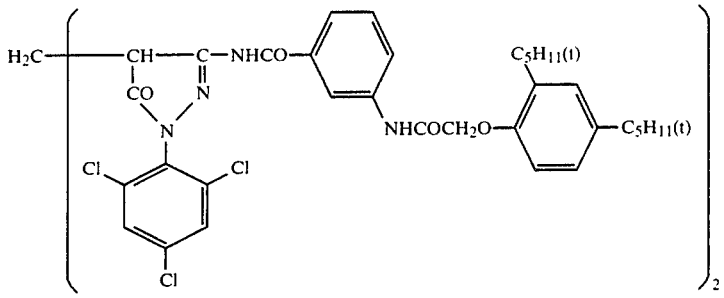
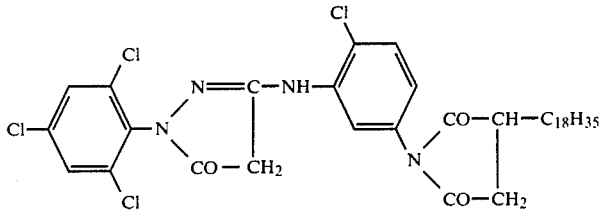
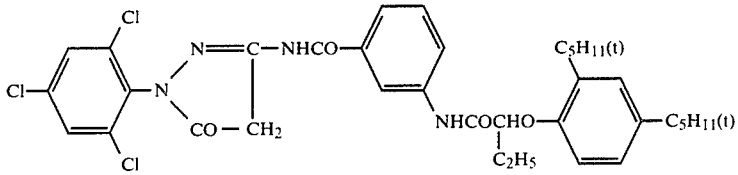
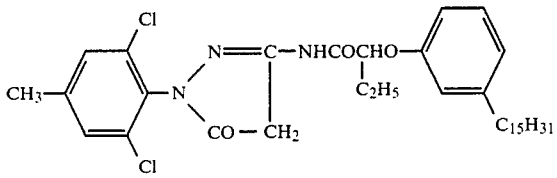
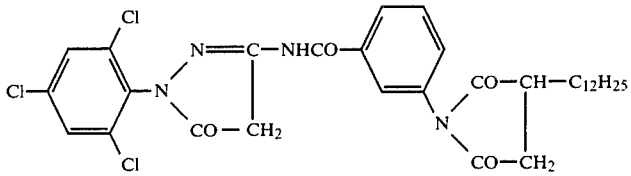
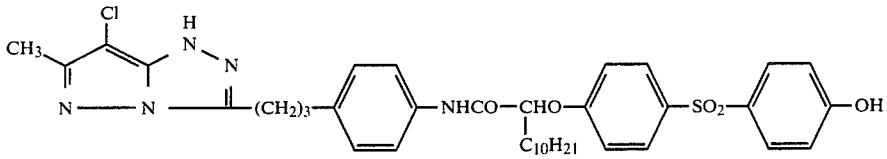
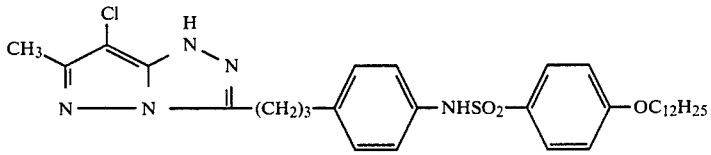
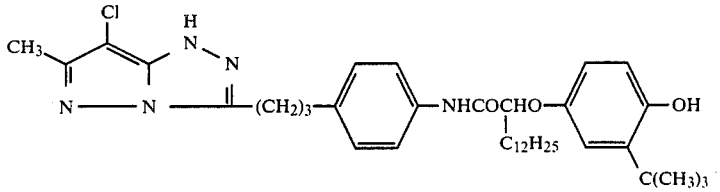

-continued
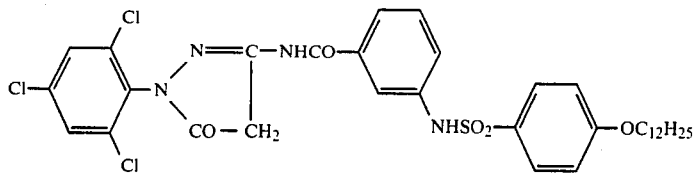
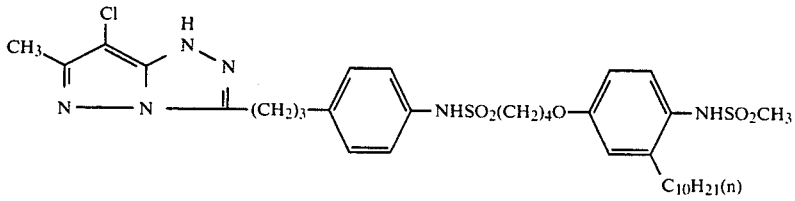
Cyan color couplers that may be used in the photographic material of the present invention include phenolic and naphtholic compounds.
Specific examples of the usable cyan color couplers are shown in U.S. Pat. Nos. 2,423,730, 2,474,293 and 2,895,826; and Unexamined Published Japanese Patent Application No. 117422/1975.
Particularly preferred cyan color couplers are listed below:
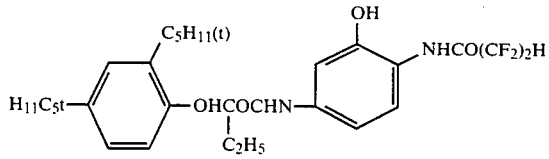
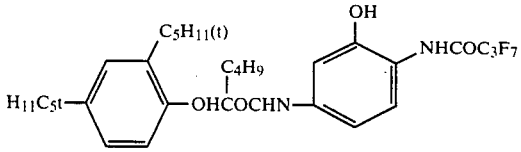
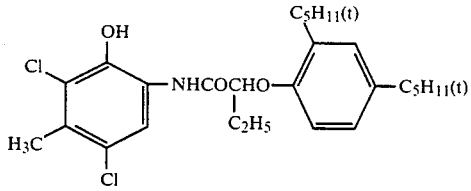
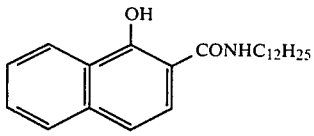
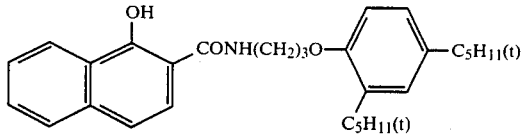
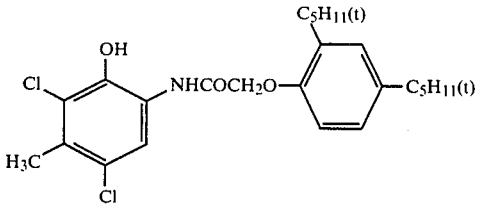
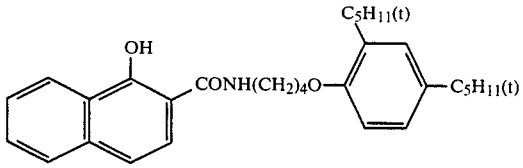
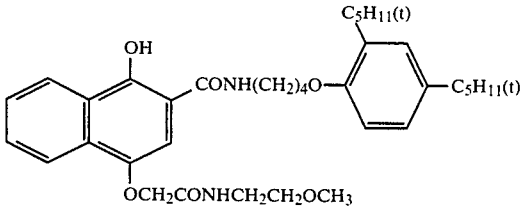
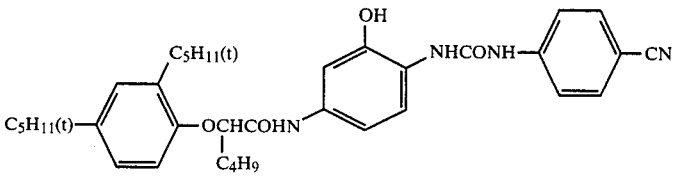

-continued

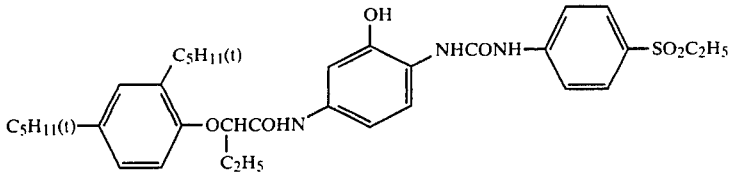

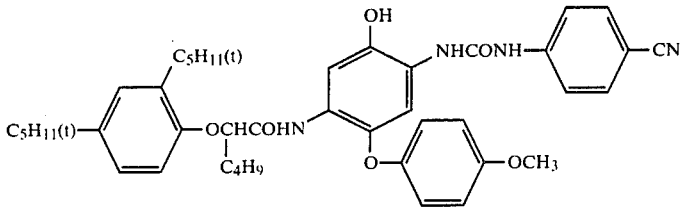

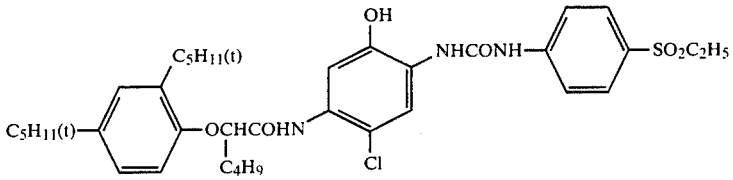

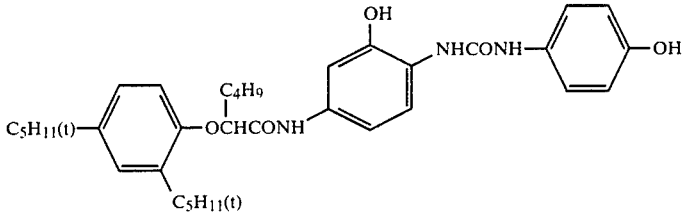

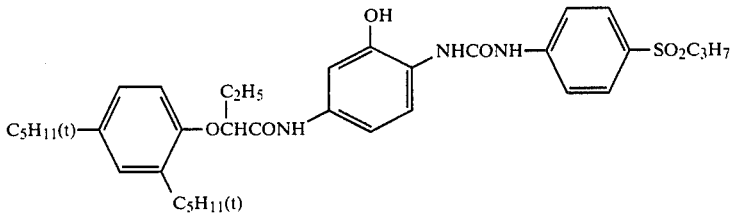

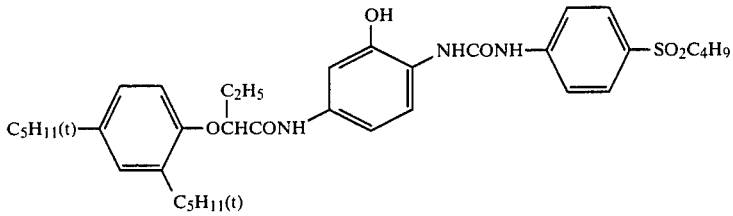

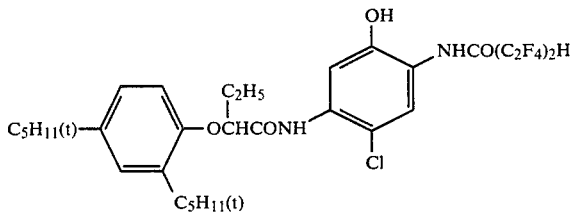

In order to attain the object of the present invention more effectively, the photographic material of the invention may use a non-diffusible coupler that reacts with the oxidation product of a color developing agent to form a suitably diffusible dye.

An example of the non-diffusible coupler that reacts with the oxidation product of a color developing agent to form a suitably diffusible dye and which may be used in the present invention is a compound represented by the following formula (A):

$(Cp)_aX$ (A)

wherein Cp is a diffusible coupler component that causes a suitable degree of dye diffusion so as to provide improved granularity; X is a group that binds with the coupler component at the coupling site and which will leave upon reaction with the oxidation product of a color developing agent, said X being a component containing a ballast group of 8–32 carbon atoms; "a" is 1 or 2.

Among the couplers represented by formula (A), those which are denoted by the following formula (I) or (II) are particularly preferred:

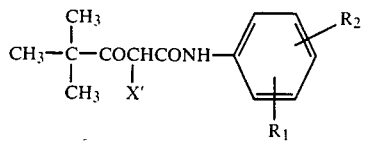
(I)

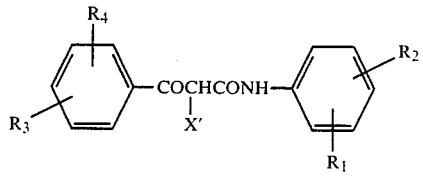
(II)

wherein $R_1$, $R_2$, $R_3$ and $R_4$ which may be the same or different represent a hydrogen atom, a halogen atom, an alkyl group (e.g. methyl, ethyl, isopropyl or hydroxyethyl), an alkoxy group (e.g. methoxy, ethoxy or methoxyethoxy), an aryloxy group (e.g. phenoxy), an acylamino group (e.g. acetylamino or trifluoroacetylamino), a sulfonamino group (e.g. methanesulfonamino or benzenesulfonamino), a carbamoyl group, a sulfamoyl group, an alkylthio group, an alkylsulfonyl group, an alkoxycarbonyl group, a ureido group, a cyano group, a carboxyl group, a hydroxy group or a sulfo group, provided that the total number of carbon atoms in $R_1$ to $R_4$ does not exceed 10;

X' is a group that has a "ballast" group of 8–32 carbon atoms for rendering the coupler nondiffusible and which is capable of leaving upon coupling with the oxidation product of an aromatic primary amine developing agent, said X' being specifically denoted by the following formula (III) or (IV):

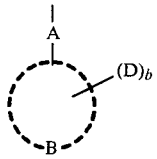
(III)

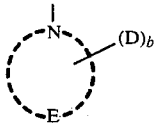
(IV)

wherein A is an oxygen or sulfur atom; B represents the group of non-metallic atoms necessary for forming an aryl or hetero ring; E represents the group of non-metallic atoms necessary for forming a 5- or 6-membered hereto ring taken together with the nitrogen atom, provided that said ring may be further fused to an aryl or hetero ring; D is a ballast group; and "b" represents a positive integer. When "b" is 2 or more, D may be the same or different and has a total carbon number of 8–32. D may contain a linkage group such as —O—, —S—, —COO—, —CONH, —$SO_2$—NH—, —NHCONH—, —$SO_2$—, —CO— or —NH—.

Other preferred examples of the coupler of formula (A) are represented by the following formula (V), (VI) or (VII):

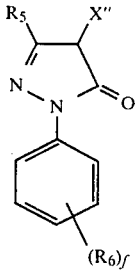
(V)

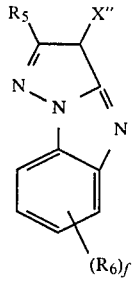
(VI)

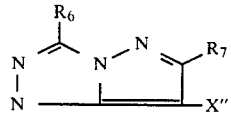
(VII)

wherein $R_5$ is an acylamino group (e.g. propanamido or benzamido), an anilino group (e.g. 2-chloroanilino or 5-acetamidoanilino), or a ureido group (e.g. phenylureido or butanureido); $R_6$ and $R_7$ are each a halogen atom, an alkyl group (e.g. methyl or ethyl), an alkoxy group (e.g. methoxy or ethoxy), an acylamino group (e.g. acetamido or benzamido), an alkoxycarbonyl (e.g. methoxycarbonyl), an N-alkylcarbamoyl (e.g. N-methylcarbamoyl), a ureido group (e.g. N-methylureido), a cyano group, an aryl group (e.g. phenyl or naphthyl), an N,N-dialkylsulfamoyl group, a nitro group, a hydroxy group, a carboxy group or an aryloxy group; "f" is an integer of 0 to 4, and if "f" is 2 or more, $R_6$ may be the same or different, provided that in formulas (V) and (VI), the total number of carbon atoms in $R_5$ and $R_6$ whose number is "f", and in formula (VII), the total number of carbon atoms in $R_6$ and $R_7$, will not exceed 10; X" is one of the groups represented by the following formulas (VIII), (IX) and (X):

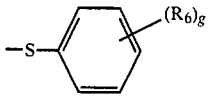
(VIII)

$-S-R_8$ (IX)

-continued

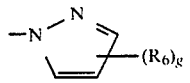

(X)

wherein $R_6$ is a group selected from among the substituents listed in the definitions of formulas (V) to (VII); when "g" is 2 or more, $R_6$ may be the same or different and the total number of carbon atoms in $R_6$ whose number is "g" ranges from 8 to 32;

$R_8$ is a substituted or unsubstituted alkyl group (e.g. butyl or dodecyl), aralkyl group (e.g. benzyl), alkenyl group (e.g. allyl) or cyclic alkyl group (e.g. cyclopentyl), with the substituent being selected from among a halogen atom, an alkoxy group (e.g. butoxy or dodecyloxy), an acylamino group (e.g. acetamido or tetradecanamido), an alkoxycarbonyl group (e.g. tetradecyloxycarbonyl), an N-alkylcarbamoyl group (e.g. N-dodecylcarbamoyl), a ureido group (e.g. tetradecylureido), a cyano group, an aryl group (e.g. phenyl), a nitro group, an alkylthio group (e.g. dodecylthio), an alkylsulfinyl group (e.g. tetradecylsulfinyl), an alkylsulfone group, an anilino group, a sulfonamido group (e.g. hexadecansulfonamido), an N-alkylsulfamoyl group, an aryloxy group or an acyl group (e.g. tetradecanoyl), with the total number of carbon atoms in $R_8$ being 8–32.

Particularly preferred examples of the coupler of formula (A) are represented by the following formula (XI) or (XII):

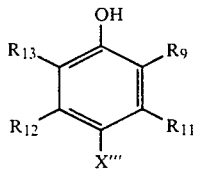

(XI)

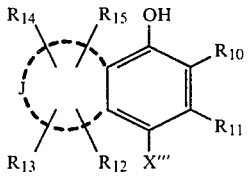

(XII)

$R_9$ is a hydrogen atom, an aliphatic group of not more than 10 carbon atoms (e.g. an alkyl group such as methyl, isopropyl, acyl, cyclohexyl or octyl), an alkoxy group having not more than 10 carbon atoms (e.g. methoxy, isopropoxy or pentadecyloxy), an aryloxy group (e.g. phenoxy or p-tert-butylphenoxy), acylamido, sulfonamido and ureido groups represented by the following formulas (XIII), (XIV) and (XV), respectively, or a carbamoyl group represented by the following formula (XVI):

$$-NH-CO-G \quad (XIII)$$

$$-NH-SO_2-G \quad (XIV)$$

$$-NHCONH-G \quad (XV)$$

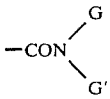

(XVI)

wherein G and G' which may be the same or different each represents a hydrogen atom (provided that G and G' are not both a hydrogen atom, with the total number of carbon atoms in G and G' being 1–12), an aliphatic group of 1–12 carbon atoms, preferably a straight-chained or branched alkyl or a cyclic alkyl group having 4–10 carbon atoms (e.g. cyclopropyl, cyclohexyl or norbonyl) or an aryl group (e.g. phenyl or naphthyl). The alkyl and aryl groups may be substituted by one or more of the following: a halogen atom (e.g. fluorine or chlorine), a nitro group, a cyano group, a hydroxyl group, a carboxyl group, an amino group (e.g. amino, alkylamino, dialkylamino, anilino, or N-alkylanilino), an alkyl group (as defined above), an aryl group (e.g. phenyl or acetylaminophenyl), an alkoxycarbonyl group (e.g. butyloxycarbonyl), an acyloxycarbonyl group, an amido group (e.g. acetamido or methanesulfonamido), an imido group (e.g. succinimido), a carbamoyl group (e.g. N,N-diethylcarbamoyl), a sulfamoyl group (e.g. N,N-diethylsulfamoyl), an alkoxy group (e.g. ethoxy, butyloxy or octyloxy), and an aryloxy group (e.g. phenoxy or methylphenoxy). In addition to these substituents, $R_9$ may contain any other commonly used substituents; $R_{10}$ is selected from among a hydrogen atom, an aliphatic group of not more than 12 carbon atoms, especially an alkyl group of 1–10 carbon atoms, and a carbamoyl group of formula (XVI); $R_{11}$, $R_{12}$, $R_{13}$, $R_{14}$ and $R_{15}$ each represents a hydrogen atom, a halogen atom, an alkyl group, an aryl group, an alkoxy group, an alkylthio group, a heterocyclic group, an amino group, a carbonamido group, a sulfonamido group, a sulfamyl group or a carbamyl group; $R_{11}$ particularly represents one of the following:

a hydrogen atom, a halogen atom (e.g. Cl or Br), a primary, secondary or tertiary alkyl group having 1 to 12 carbon atoms (e.g. methyl, propyl, isopropyl, n-butyl, sec-butyl, tert-butyl, hexyl, dodecyl, 2-chlorobutyl, 2-hydroxyethyl, 2-phenylethyl, 2-(2,4,6-trichlorophenyl)ethyl or 2-aminoethyl), an alkylthio group (e.g. octylthio), an aryl group (e.g. phenyl, 4-methylphenyl, 2,4,6-trichlorophenyl, 3,5-dibromophenyl, 4-trifluoromethylphenyl, 2-tolylfluoromethylphenyl, 3-trifluoromethylphenyl, naphthyl, 2-chloronaphthyl or 3-ethylnaphthyl), a heterocyclic group (e.g. benzofuranyl, furanyl, thiazolyl, benzothiazolyl, naphthothiazolyl, oxazolyl, benzoxazolyl, naphthoxazolyl, pyridyl or quinolinyl), an amino group (e.g. amino, methylamino, diethylamino, dodecylamino, phenylamino, tolylamino, 4-cyanophenylamino, 2-trifluoromethylamino or benzothiazolamino), a carbonamido group (e.g. an alkylcarbonamido group such as ethylcarbonamido or decylcarbonamido; an arylcarbonamido group such as phenylcarbonamido, 2,4,6-trichlorophenylcarbonamido, 4-methylphenylcarbonamido, 2-ethoxyphenylcarbonamido or naphthylcarbonamido; or a heterocyclic carbonamido group such as thiazolylcarbonamido, benzothiazolylcarbonamido, naphthothiazolylcarbonamido, oxazolylcarbonamido, benzoxazolylcarbonamido, imidazolylcarbonamido or benzimidazolylcarbonamido), a sulfonamido group (e.g. an alkylsulfonamido group such as butylsulfonamido, dodecylsulfonamido or phenylethylsulfonamido; an arylsulfonamido group such as phenylsulfonamido, 2,4,6-trichlorophenylsulfonamido, 2-methoxyphenylsulfonamido, 3-carboxyphenylsulfonamido or naphthylsulfonamido; or a heterocyclic sulfonamido group such as thiazolylsulfonamido, benzothiazolylsulfonamido, imidazolylsulfonamido, benzimidazolylsulfonamido or pyridylsulfonamido), a sulfamyl group (e.g. an alkylsulfamyl group such as propylsulfamyl or octylsulfamyl; an arylsulfamyl group such as phenylsulfamyl, 2,4,6-trichlorophenylsulfamyl, 2-methoxyphenylsulfamyl or naphthylsulfamyl; a heterocyclic sulfamyl group such as thiazolylsulfamyl, benzothiazolylsulfamyl, oxazolylsulfamyl, benzimidazolylsulfamyl or pyridylsulfamyl) and a carbamyl group (e.g. an alkylcarbamyl group such as ethylcarbamyl or octylcarbamyl; an arylcarbamyl group such as phenylcarbamyl or 2,4,6-trichlorophenylcarbamyl; or a heterocyclic carbamyl group such as thiazolylcarbamyl, benzothioazolylcarbamyl, oxazolylcarbamyl, imidazolylcarbamyl or benzimidazolylcarbamyl). For details of $R_{12}$ to $R_{15}$, reference should be made to the description of $R_{11}$. In formula (XII), J represents the group of nonmetallic atoms necessary for forming one of the following 5- or 6-membered rings: benzene, cyclohexene, cyclopentene, thiazole, oxazole, imidazole, pyridine and pyrrole rings, with the benzene ring preferred;

X″ represents a group of 8–32 carbon atoms that is bonded to the coupling site by —O—, —S— or —N=N— and which leaves upon coupling with the oxidation product of an aromatic primary amine developing agent, preferred examples of X″ including alkoxy, aryloxy, alkylthio, arylthio, alkylazo and arylazo groups of 8–32 carbon atoms; these groups may contain divalent groups such as —O—, —S—, —NH—, —CONH—, —COO—, —$SO_2$NH—, —SO—, —$SO_2$—, —CO—,

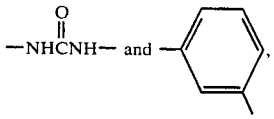

with the particularly prefered case being such that these groups contain alkyl-dissociable groups such as —COOH, —$SO_3$H, —OH and —$SO_2NH_2$. The coupler may be rendered substantially nondiffusible by combining $R_9$ to $R_{15}$ and X‴.

Preferred examples of the couplers that are represented by formula (A) and which form suitably diffusible dyes upon coupling reaction are listed below.

Yellow couplers

Y-1

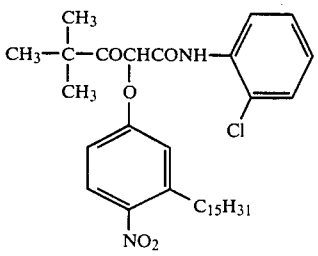

-continued

Y-2

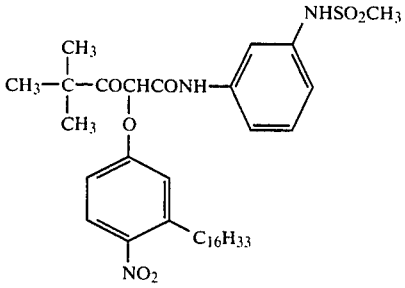

Y-3

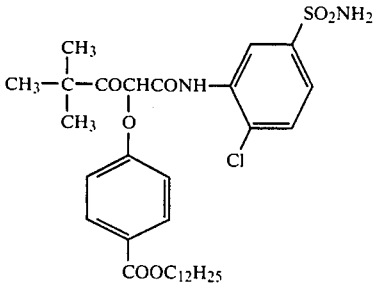

Y-4

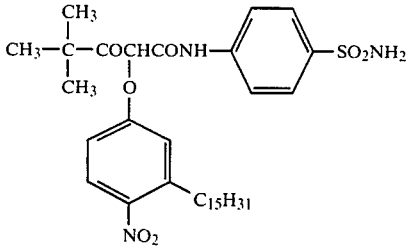

Y-5

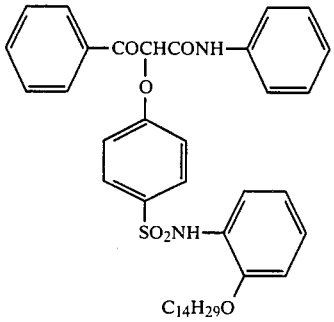

Y-6

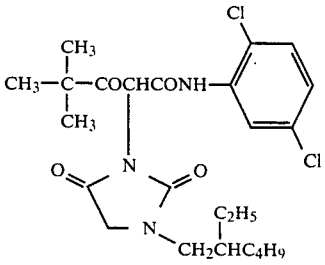

-continued
Y-7
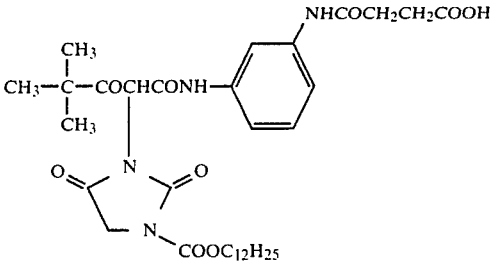
Y-8
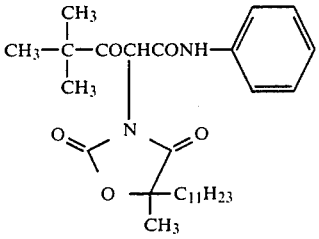
Y-9
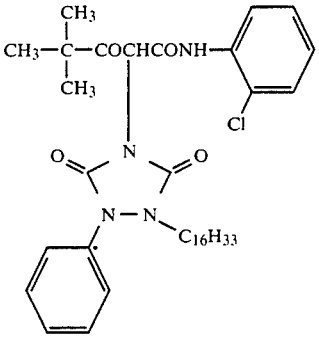
Y-10
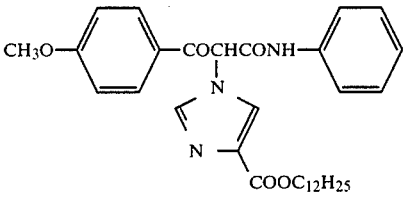
Y-11
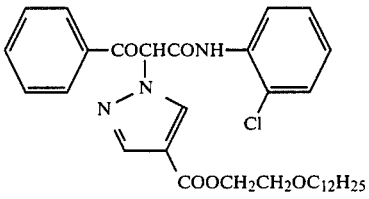
-continued
Y-12
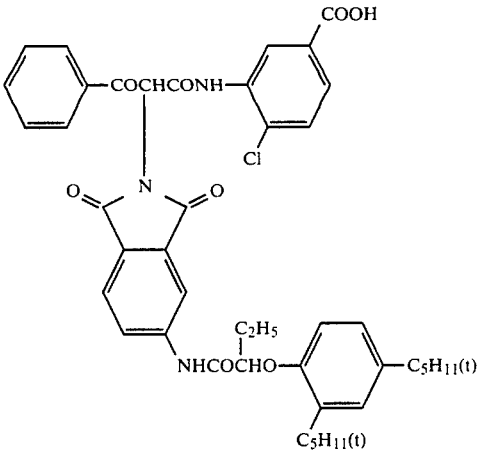
Y-13
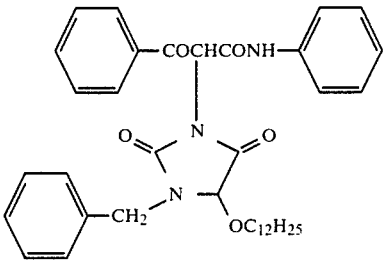
Y-14
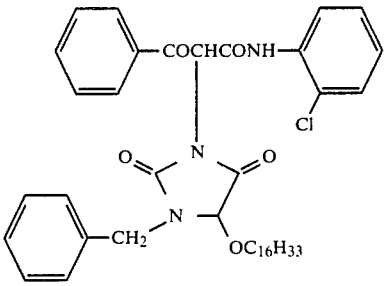
Magenta couplers
M-1
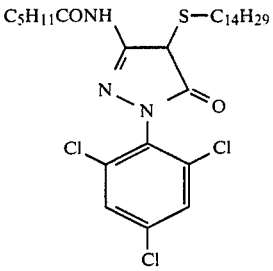
M-2
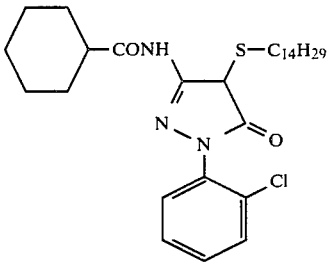

-continued
M-3
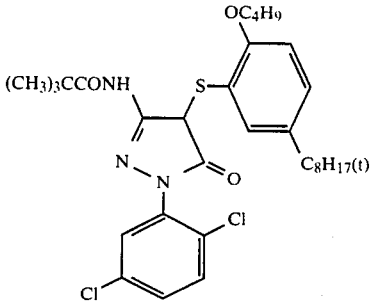
M-4
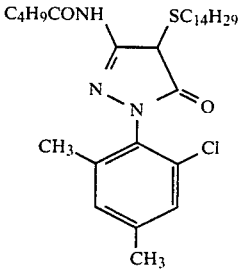
M-5
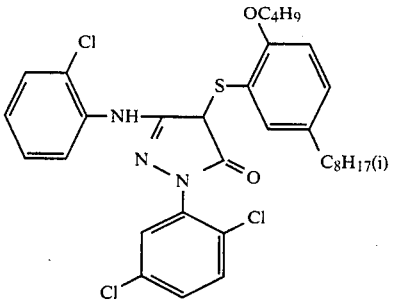
M-6
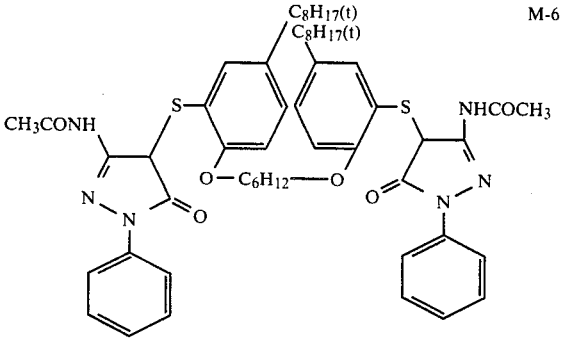
M-7
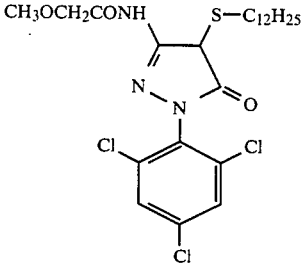
-continued
M-8
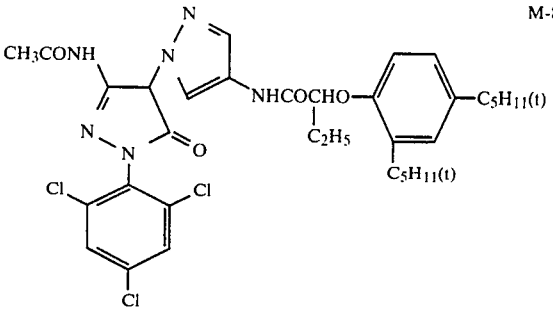
M-9
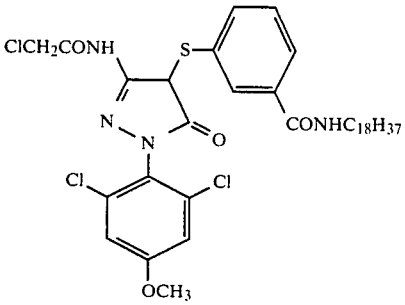
M-10
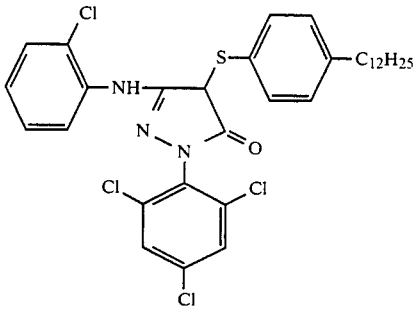
M-11
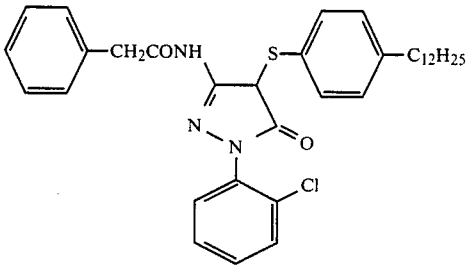
M-12
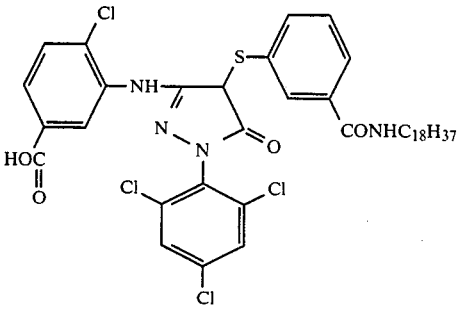

-continued
M-13
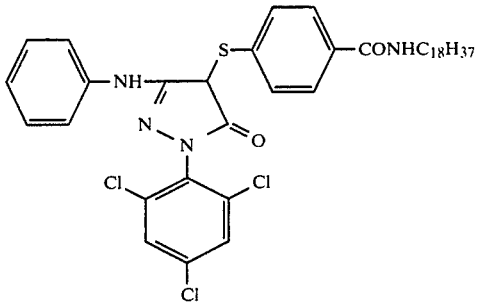
M-14
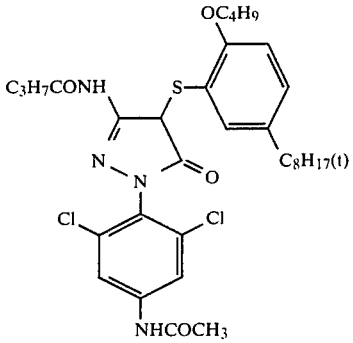
M-15
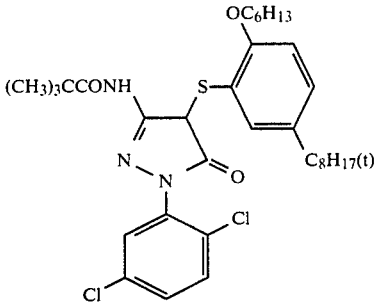
M-16
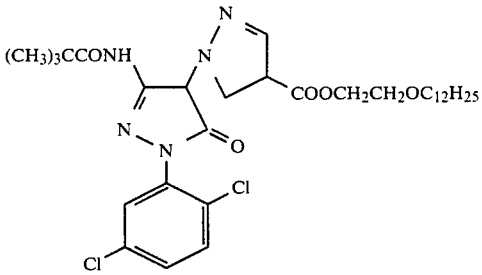
Cyan couplers
C-1
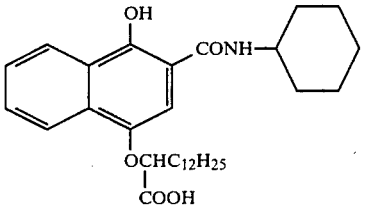
-continued
C-2
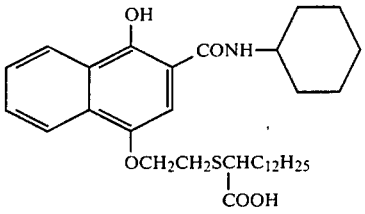
C-3
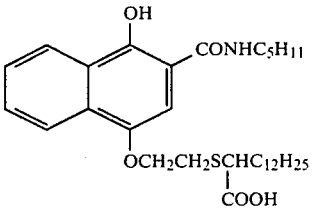
C-4
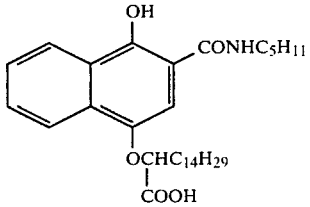
C-5
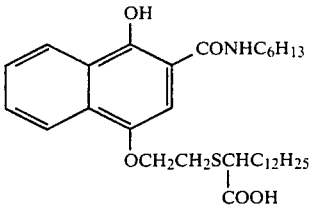
C-6
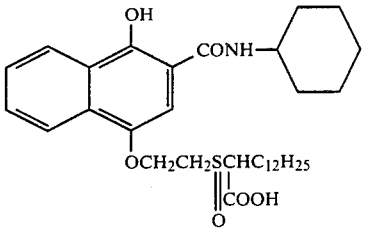
C-7
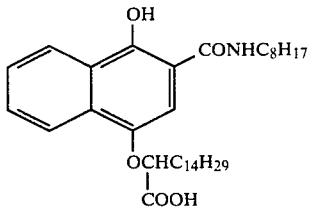
C-8
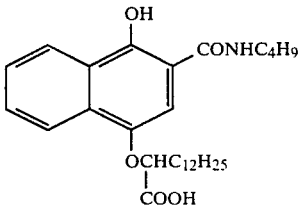

-continued
C-9
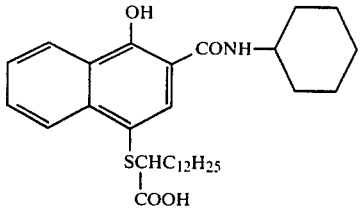
C-10
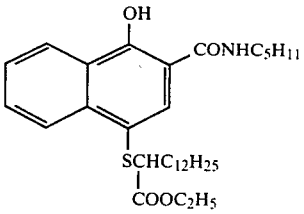
C-11
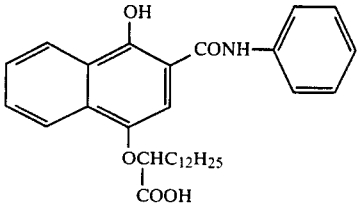
C-12
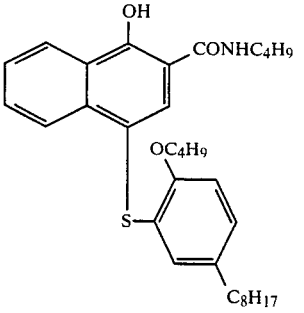
C-13
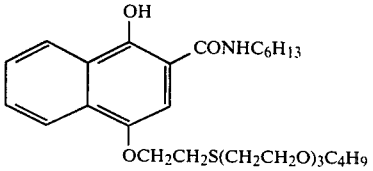
C-14
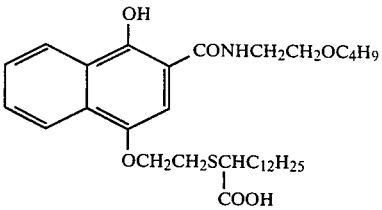
C-15
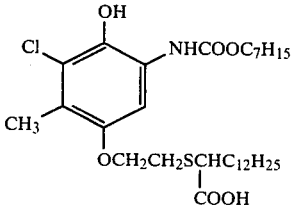
-continued
C-16
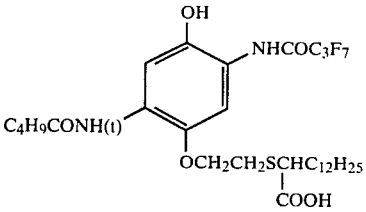
C-17
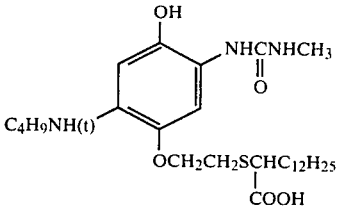
C-18
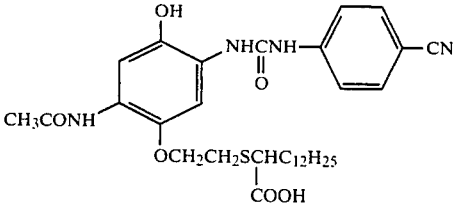
C-19
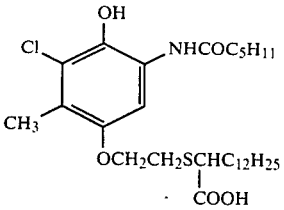
C-20
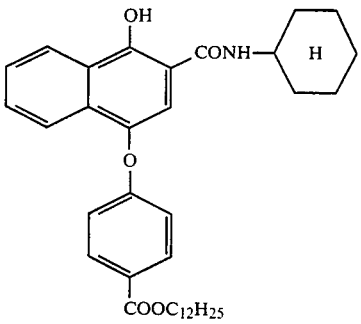
C-21
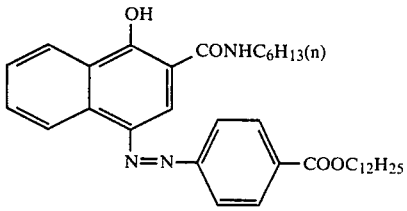

-continued

C-22

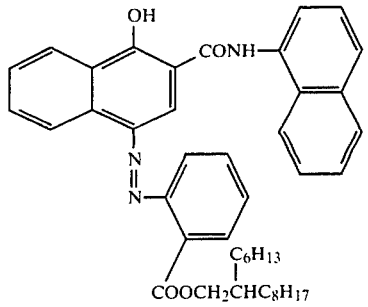

C-23

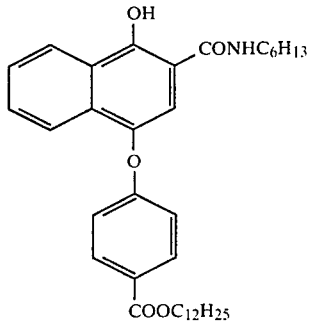

C-24

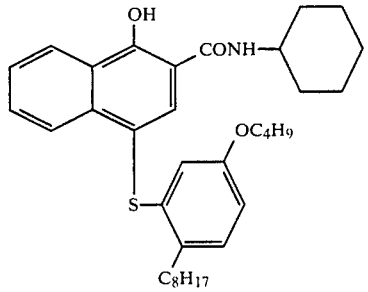

The yellow and magenta couplers illustrated above may be synthesized by any of the methods described in U.S. Pat. Nos. 4,264,723, 3,227,554, 4,310,619 and 4,301,235; and Unexamined Published Japanese Patent Application Nos. 4044/1982, 126833/1981 and 122935/1975. The compounds C-1 to C-19 are readily synthesized by any of the methods described in Unexamined Published Japanese Patent Application Nos. 1938/1981, 3934/1982, and 105226/1978.

The total amount of the couplers used in the silver halide emulsion layers may be properly selected depending upon the maximum density of each coupler, which in turn depends on the color forming ability of the coupler. Preferably, about 0.01–0.30 mol of the couplers are used per mol of silver halide.

In a preferred embodiment of the present invention, a compound that releases a development inhibitor or its precursor upon reaction with the oxidation product of a color developing agent (such compound is hereunder referred to as the DIR compound of the present invention) is incorporated in at least one of the light-sensitive silver halide emulsion layers. In a more preferred embodiment, such DIR compound of the present invention is incorporated in at least one of blue-, green- and red-sensitive silver halide emulsion layers of high sensitivity, BH, GH and RH.

Typical examples of such DIR compound are DIR couplers having at the active site a group capable of forming a development inhibiting compound upon leaving said active site; such DIR couplers are described in British Pat. No. 935,454, U.S. Pat. Nos. 3,227,554, 4,095,984, and 4,149,886; and Unexamined Published Japanese Patent Application No. 151944/1982. These DIR couplers have such properties that when entering into coupling reaction with the oxidation product of a color developing agent, the coupler nucleus forms a dye while releasing a development inhibitor. Also included in the scope of the invention are compounds that, when coupling with the oxidation product of a color developing agent, release a development inhibitor but do not form a dye, as described in U.S. Pat. Nos. 3,652,345, 3,928,041, 3,958,993, 3,961,959 and 4,052,213; and Unexamined Published Japanese Patent Application Nos. 110529/1978, 13333/1979 and 161237/1980.

Timed DIR compounds may also be used in the present invention; they are such compounds that, when reacting with the oxidation product of a color developing agent, the nucleus forms a dye or a colorless compound while the leaving timing group releases a development inhibitor by intramolecular nucleophilic displacement reaction or elimination reaction. Such timed DIR compounds are described in Unexamined Published Japanese Patent Application Nos. 145135/1979, 114946/1981 and 154234/1982.

Other timed DIR compounds that may be used in the present invention are of the type described in Unexamined Published Japanese Patent Application Nos. 160954/1983 and 162949/1983; they are such that the timing group as defined above is bonded to the coupler nucleus that forms a completely diffusible dye upon reaction with the oxidation product of a color developing agent.

The DIR compounds which are particularly preferred for the purpose of the present invention are represented by the following formulas (I) and (II), with the compounds of formula (II) being most preferred:

Coup—inhibitor (I)

wherein Coup is a coupler component (compound) capable of coupling with the oxidation product of a color developing agent and is illustrated by open-chain ketomethylene compounds such as acylacetanilides and acylacetate esters; dye forming couplers such as pyrazolones, pyrazolotriazoles, pyrazolinobenzimidazoles, indazolones, phenols and naphthols; substantially non-dye forming coupling components such as acetophenones, indanones and oxazolones;

the "inhibitor" is a component (compound) that, upon reaction with the color developing agent, leaves the compound of (I) so as to inhibit the development of silver halide; preferred compounds are heterocyclic compounds and heterocyclic mercapto compounds such as benzotriazole and 3-octylthio-1,2,4-triazole.

Illustrative heterocyclic groups in these heterocyclic compounds and heterocyclic mercapto compounds include tetrazolyl, thiadiazolyl, oxadiazolyl, thiazolyl, oxazolyl, imidazolyl and triazolyl, and more specific examples are 1-phenyltetrazolyl, 1-ethyltetrazolyl, 1-(4-hydroxyphenyl)tetrazolyl, 1,3,4-thiazolyl, 5-methyl-1,3,4-oxadiazolyl, benzthiazolyl, benzoxazolyl, benzimizolyl and 4H-1,2,4-triazolyl.

In formula (I), the "inhibitor" is bonded to the active site of Coup.

Coup—TIME—inhibitor (II)

wherein the "inhibitor" has the same meaning as defined for formula (I); Coup is the same as defined for formula (I) and includes coupler components that form a completely diffusible dye; TIME is illustrated by, but not limited to, the groups represented by the following formulas (III), (IV), (V) and (VI):

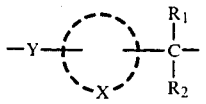

(III)

wherein X represents the atomic group necessary for complete formation of a benzene or naphthalene ring; Y represents

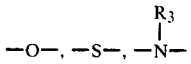

(wherein $R_3$ is a hydrogen atom, an alkyl group or an aryl group) and is bonded to the coupling site; $R_1$ and $R_2$ represent groups which have the same meaning as $R_3$, except that

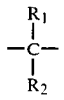

is in the position ortho or para to Y and bonded to a hetero atom in the inhibitor;

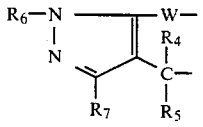

(IV)

wherein W is the same as defined for Y in formula (III); $R_4$ and $R_5$ respectively have the same meanings as those of $R_1$ and $R_2$ defined for formula (III); $R_6$ is a hydrogen atom, an alkyl group, an aryl group, an acyl group, a sulfon group, an alkoxycarbonyl group, or a heterocyclic residue; $R_7$ is a hydrogen atom, an alkyl group, an aryl group, a heterocyclic residue, an alkoxy group, an amino group, an acylamido group, a sulfonamido group, a carboxy group, an alkoxycarbonyl group, a carbamoyl group or a cyanogroup; the timing group of formula (IV) is bonded to the coupling site of Coup by W and to a hetero atom in the inhibitor by

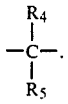

A timing group that releases an inhibitor by intramolecular nucleophilic displacement reaction may be represented by formula (V):

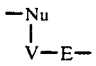

(V)

wherein N is a nucleophilic group having an electron-rich oxygen, sulfur or nitrogen atom and is bonded to the coupling site of Coup; E is an electrophilic group having an electron-deficient carbonyl, thiocarbonyl, phosphinyl or thiophosphinyl group and is bonded to a hetero atom in the inhibitor; V is a bonding group that sterically relates Nu to E in such a manner that after Nu is released from Coup, V is subjected to intramolecular nucleophilic displacement reaction involving the formation of a 3- to 7-membered ring, thereby causing the release of the inhibitor;

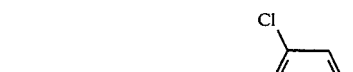

Coup—$OCH_2$—inhibitor (VI)

wherein Coup and inhibitor have the same meanings as defined above.

Typical but any no means limiting examples of the DIR compounds that may be used in the invention are listed below.

(D-1)

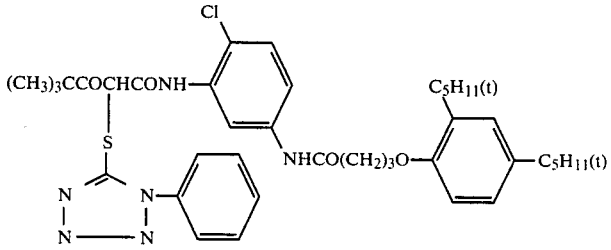

(D-2)

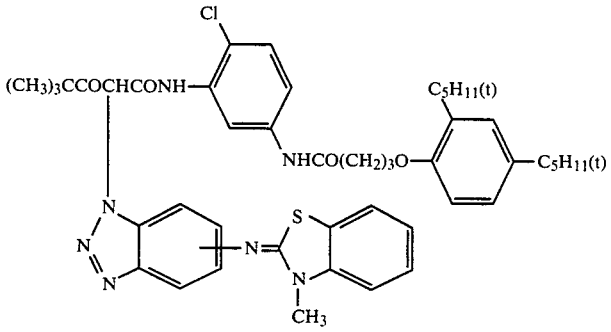

-continued
(D-3)
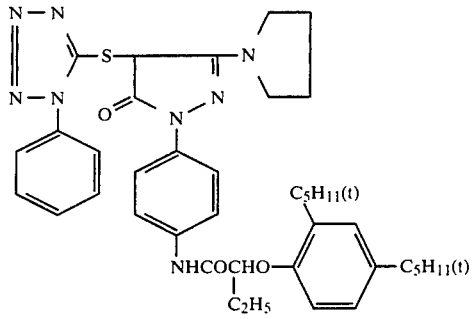
(D-4)
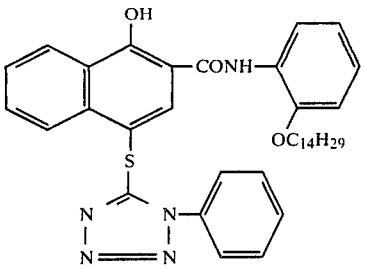
(D-5)
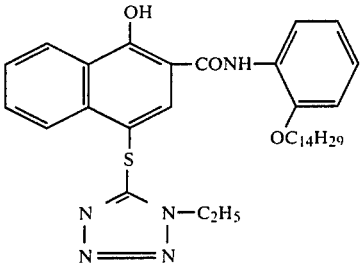
(D-6)
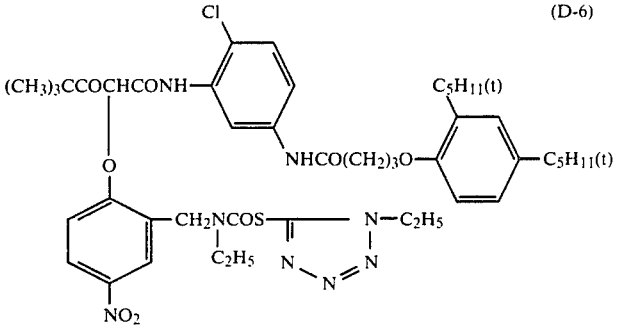
(D-7)
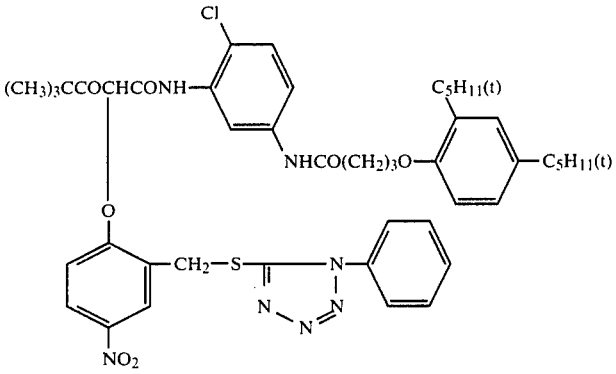
(D-8)
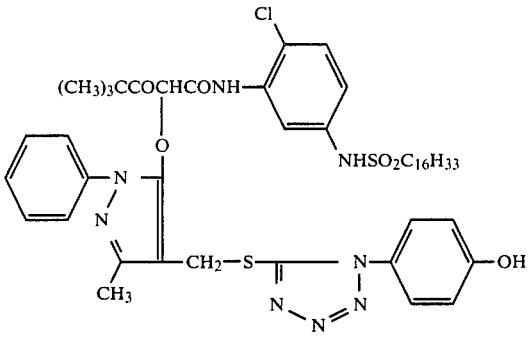
(D-9)
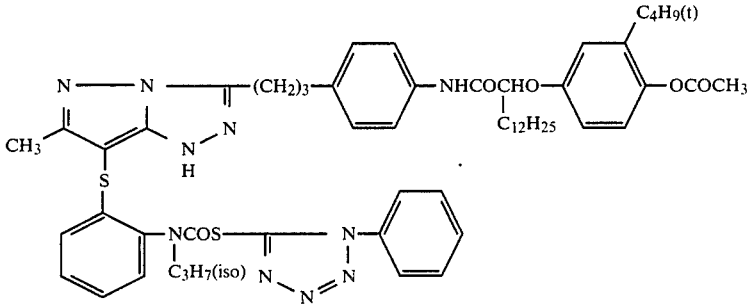

-continued
(D-10)
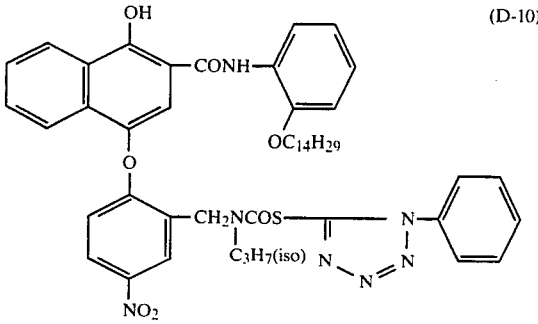
(D-11)
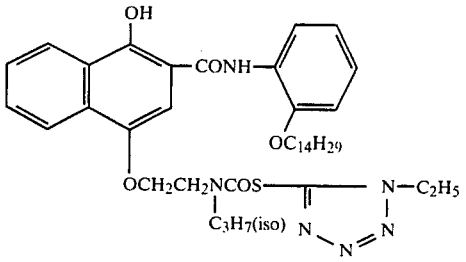
(D-12)
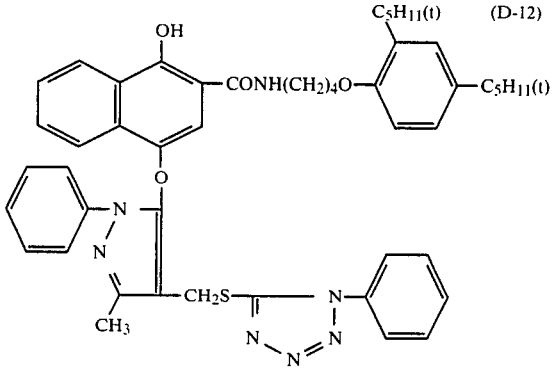
(D-13)
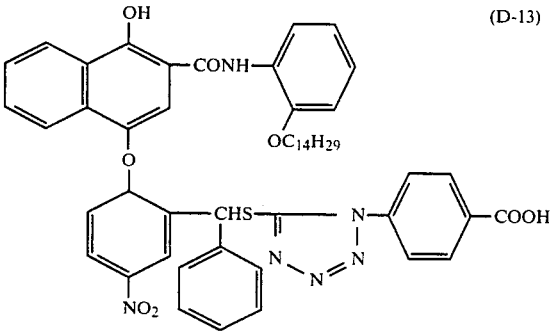
(D-14)
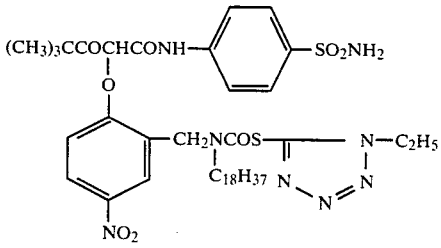
(D-15)
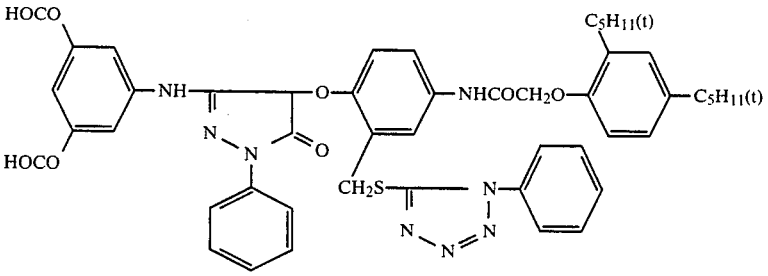
(D-16)
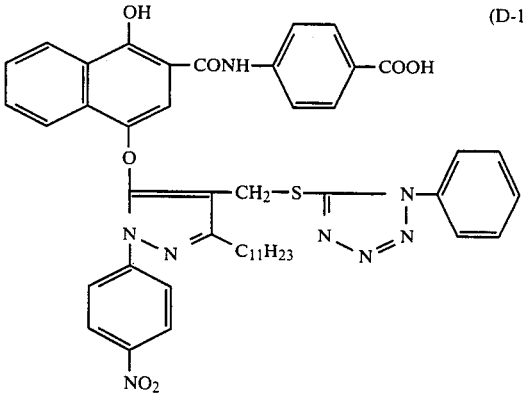
(D-17)
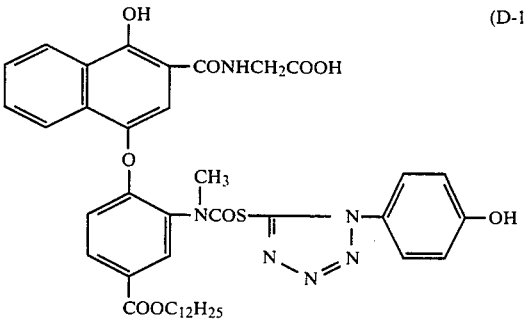

-continued
(D-18)
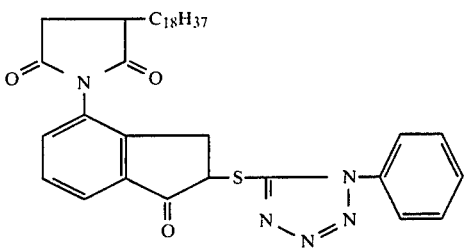
(D-19)
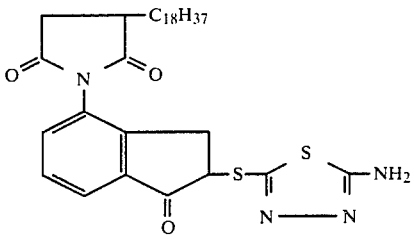
(D-20)
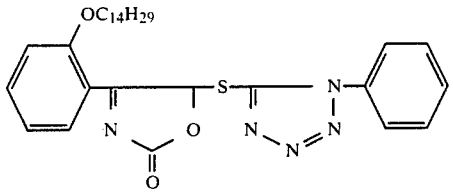
(D-21)
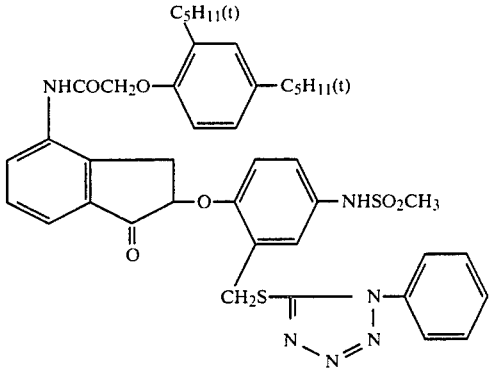
(D-22)
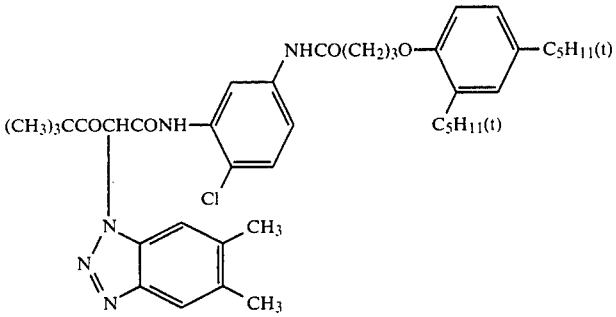
(D-23)
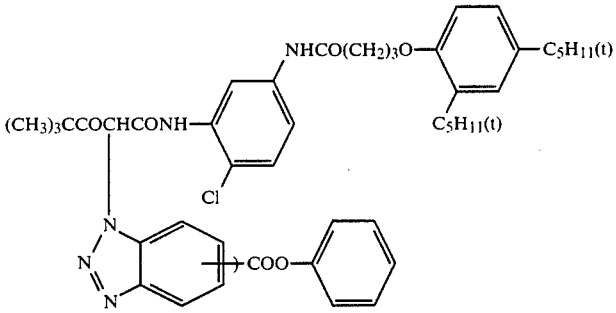
(D-24)
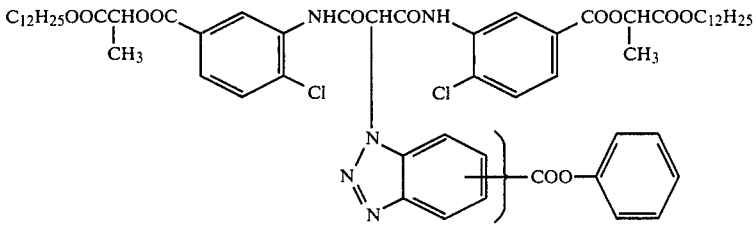

-continued
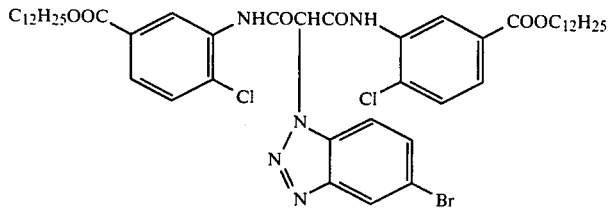
(D-25)
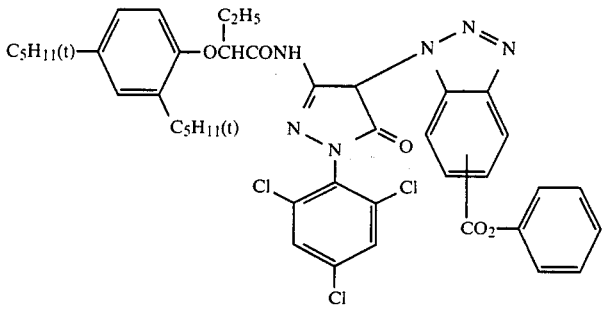
(D-26)
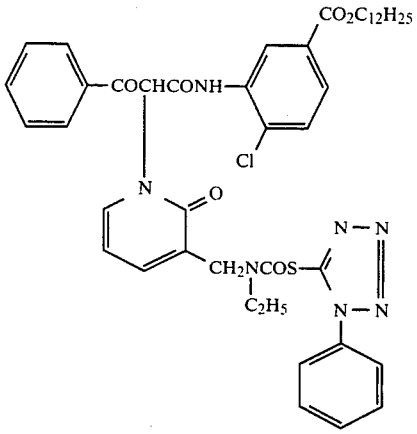
(D-27)
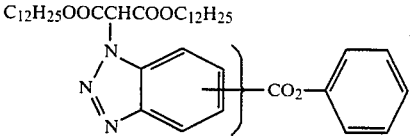
(D-28)
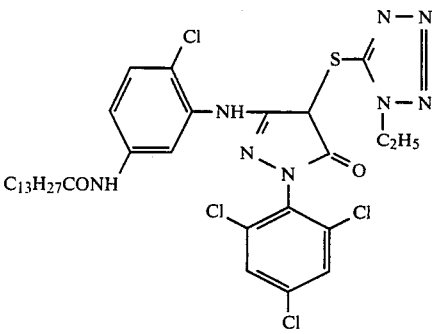
(D-29)
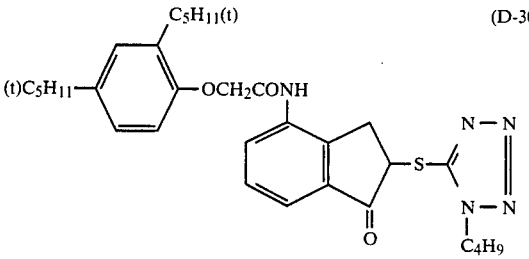
(D-30)

-continued
(D-31)
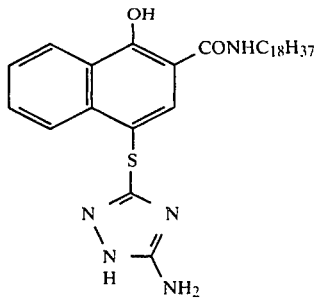
(D-32)
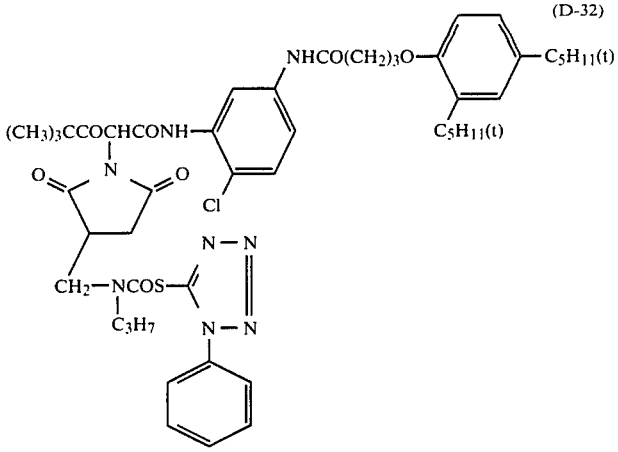
(D-33)
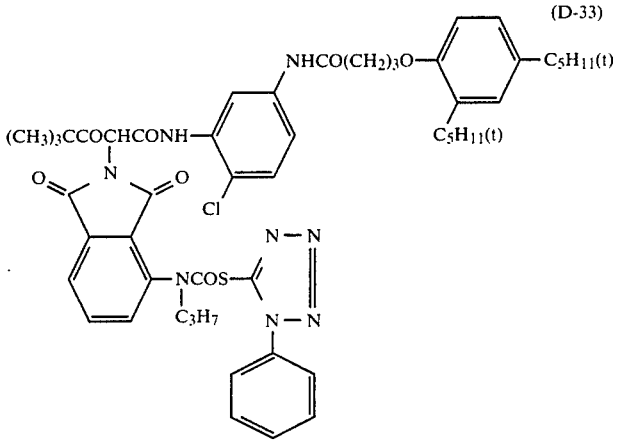
(D-34)
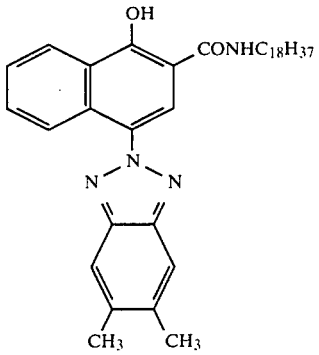
(D-35)
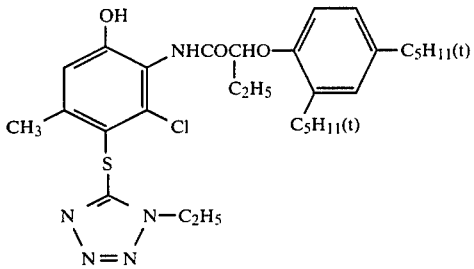
(D-36)
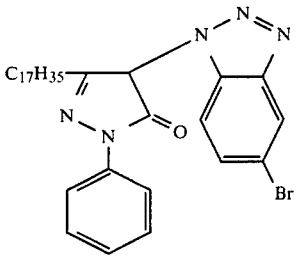
(D-37)
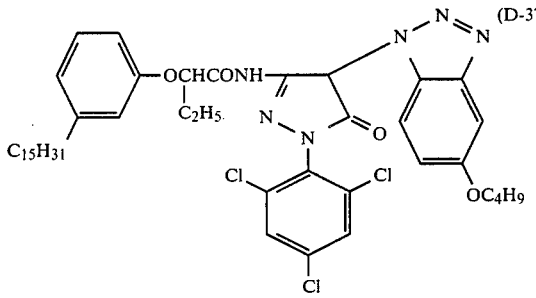
(D-38)
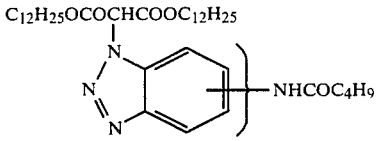

-continued
(D-39)
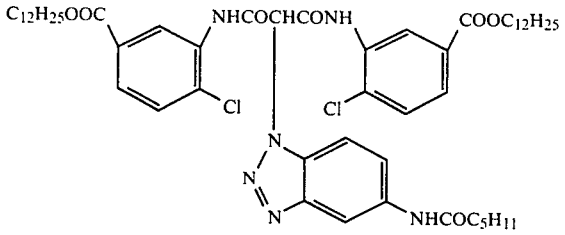
(D-40)
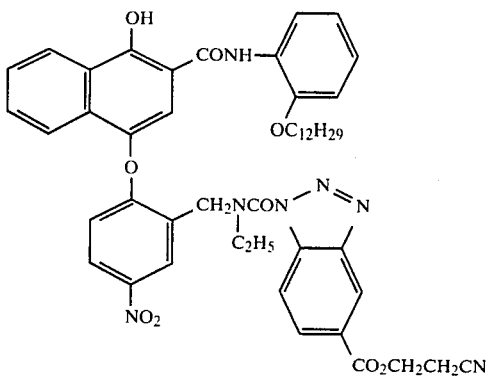
(D-41)
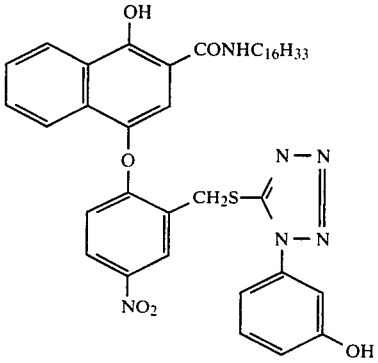
(D-42)
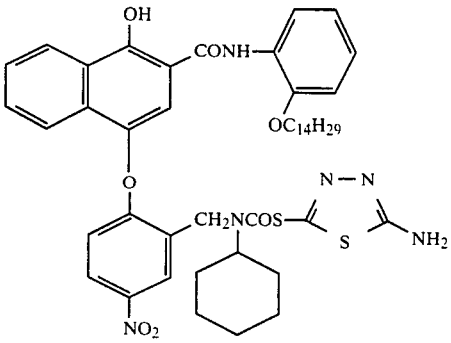
(D-43)
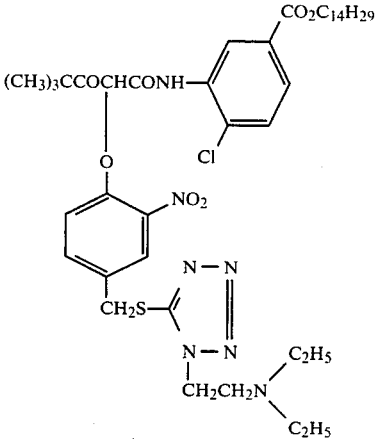
(D-44)
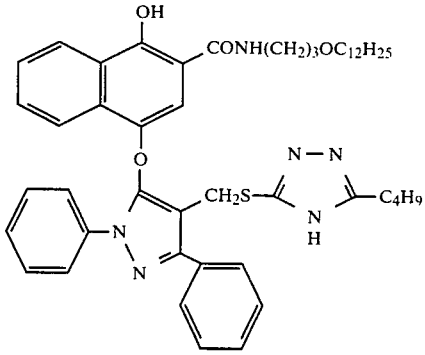
(D-45)
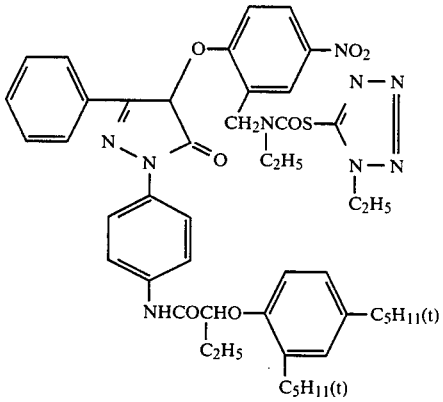
(D-46)
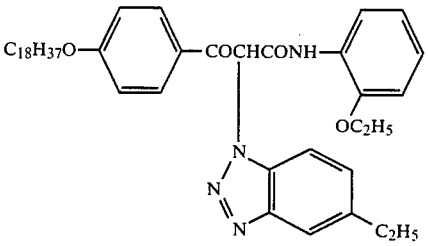

-continued
(D-47)
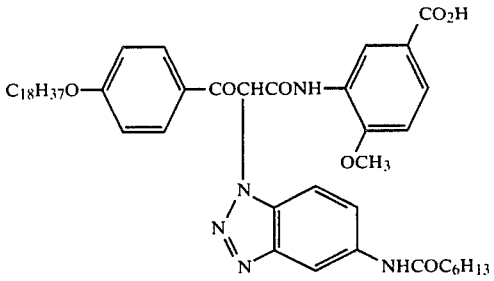
(D-48)
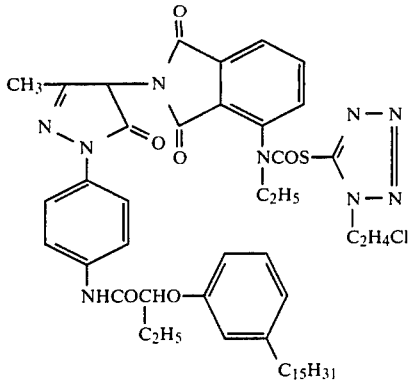
(D-49)
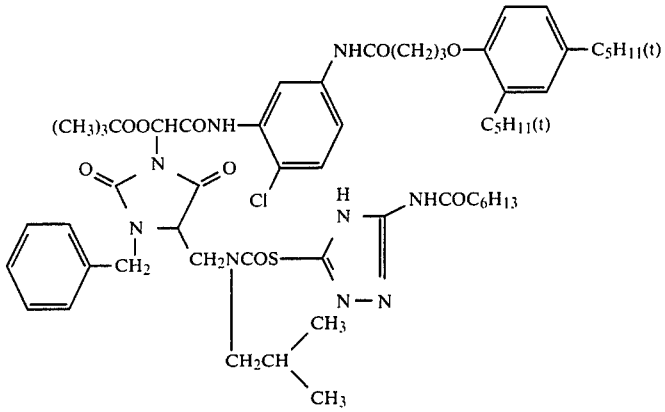
(D-50)
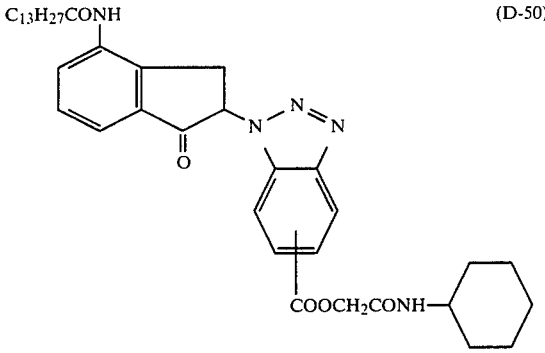
(D-51)
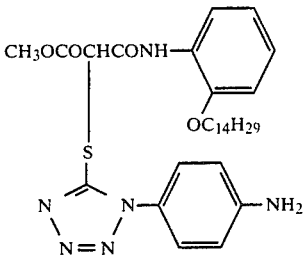
(D-52)
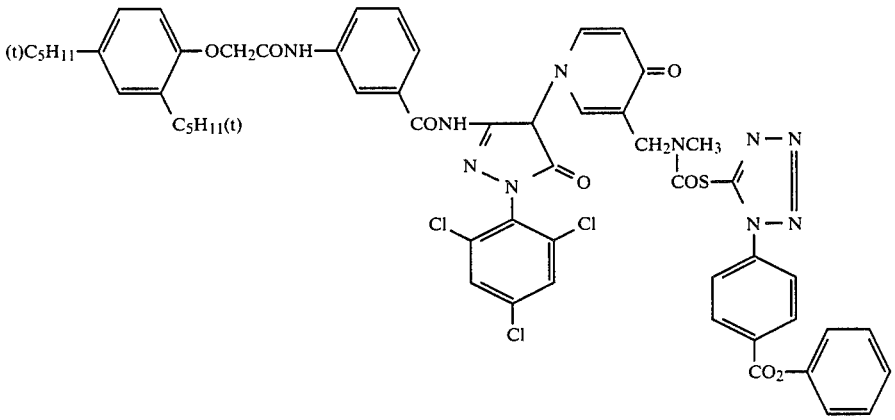

-continued
(D-53)
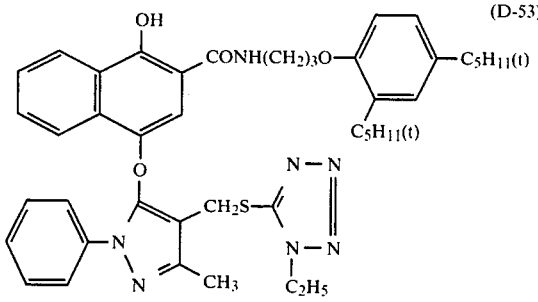
(D-54)
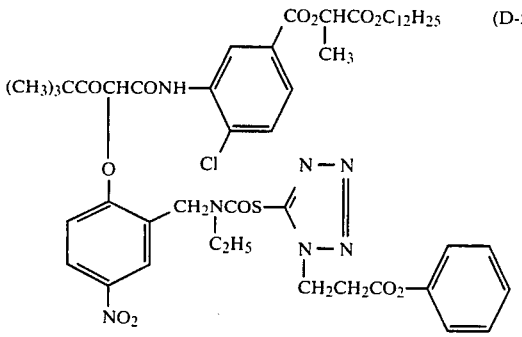
(D-55)
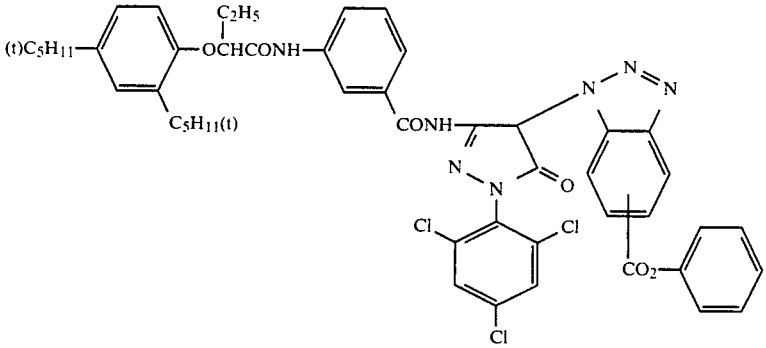
(D-56)
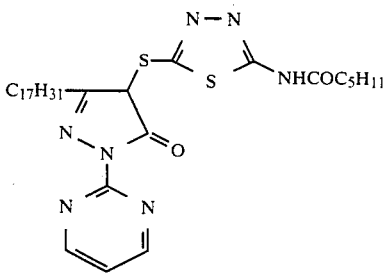
(D-57)
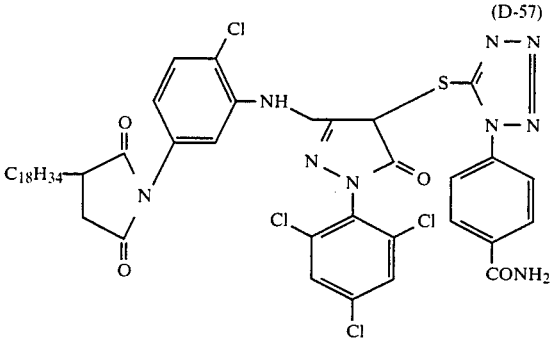
(D-58)
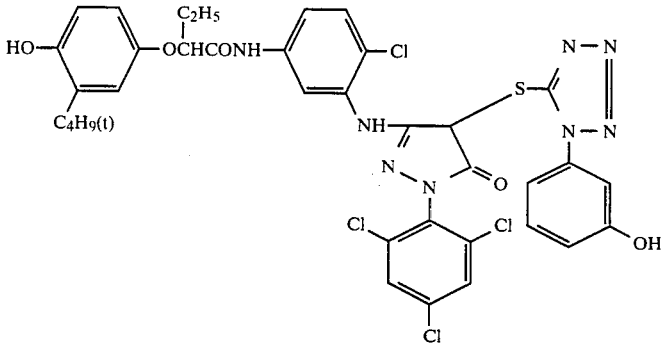
(D-59)
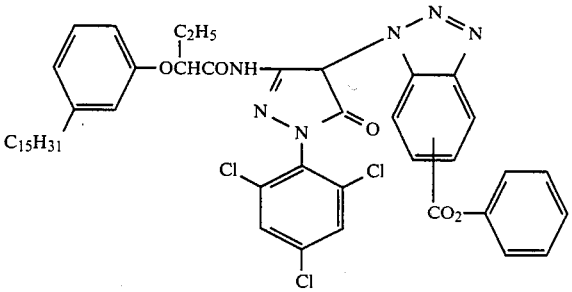

-continued
(D-60)
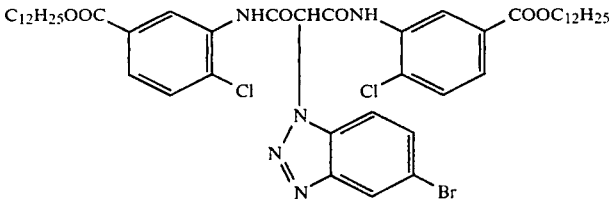
(D-61)
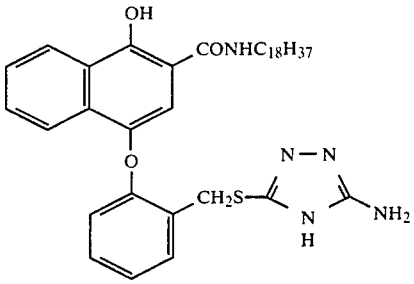
(D-62)
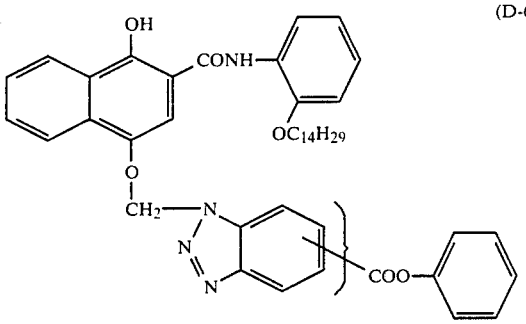
(D-63)
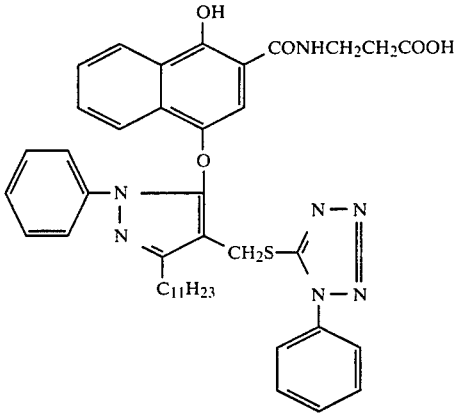
(D-64)
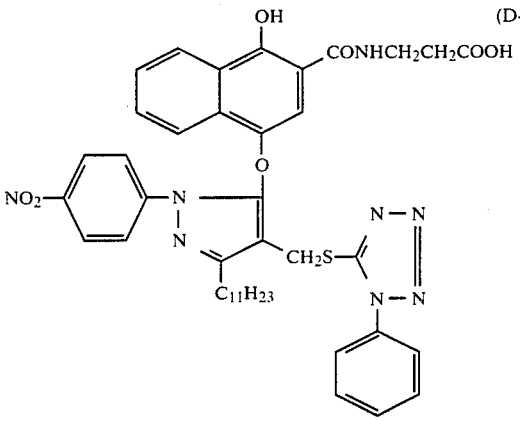
(D-65)
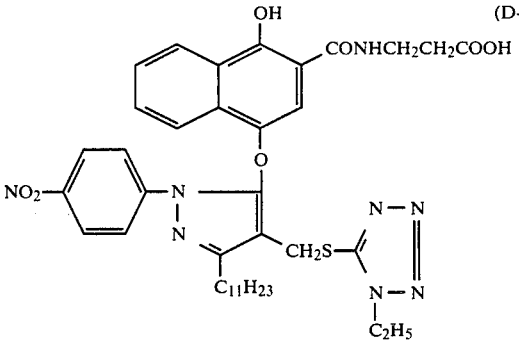
(D-66)
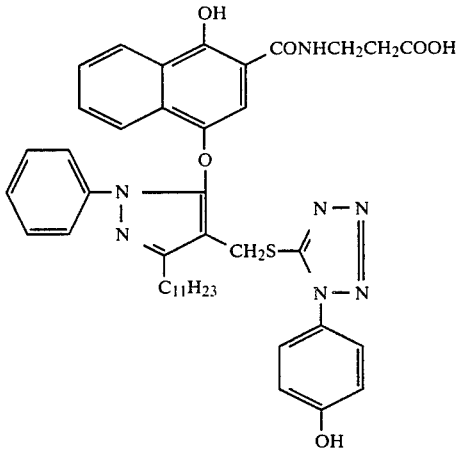

-continued
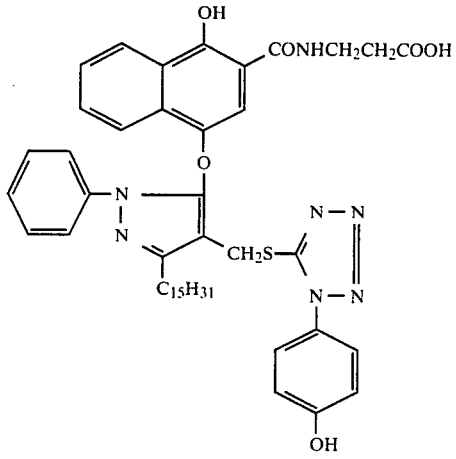
(D-67)
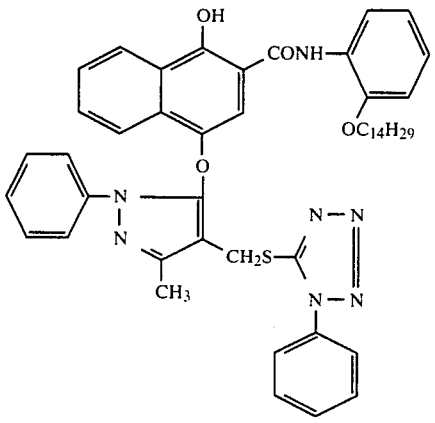
(D-68)
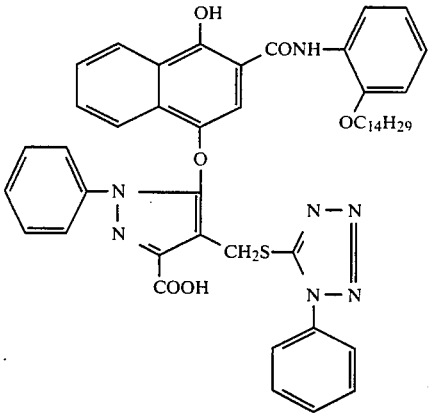
(D-69)
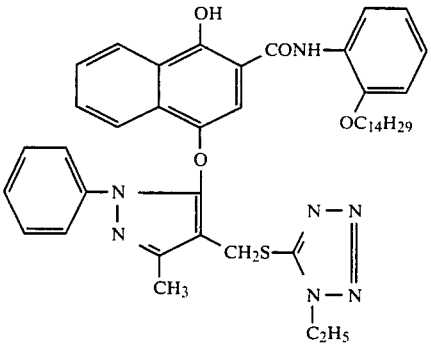
(D-70)
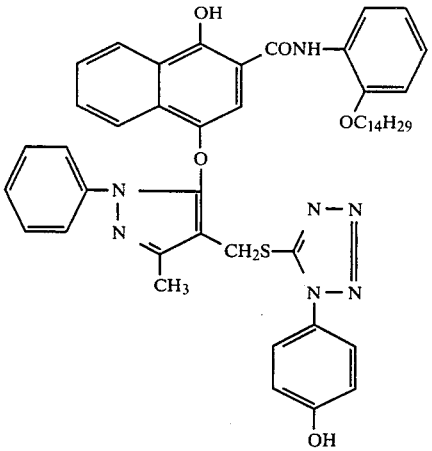
(D-71)
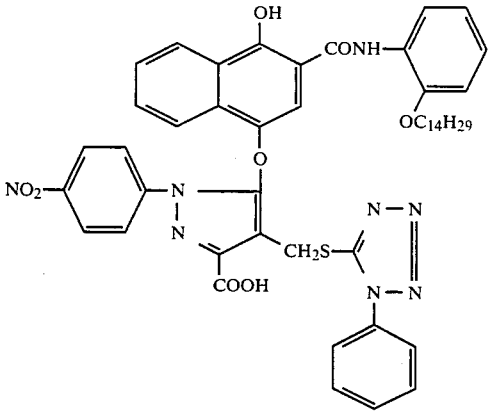
(D-72)

-continued
(D-73)
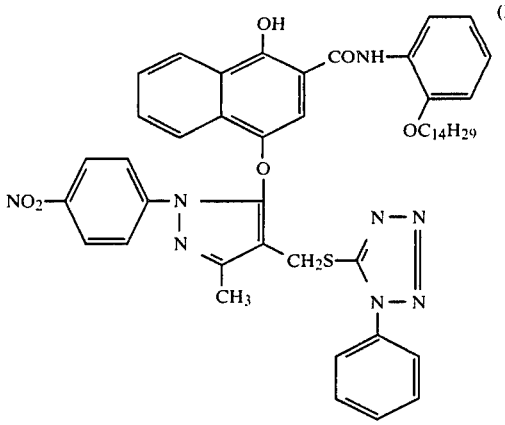
(D-74)
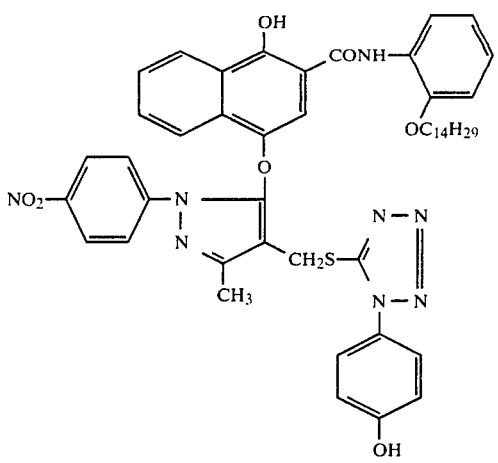
(D-75)
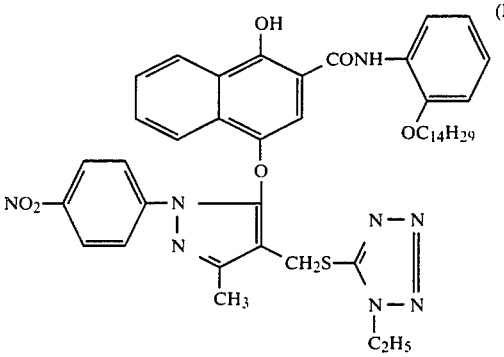
(D-76)
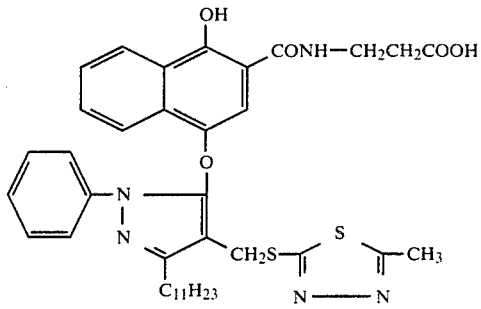
(D-77)
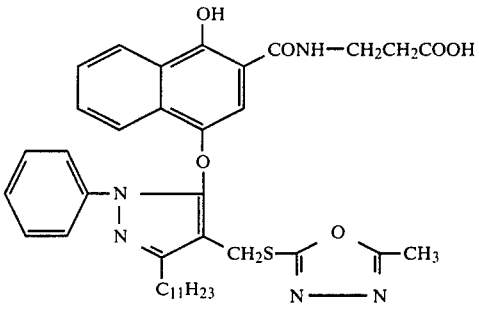
(D-78)
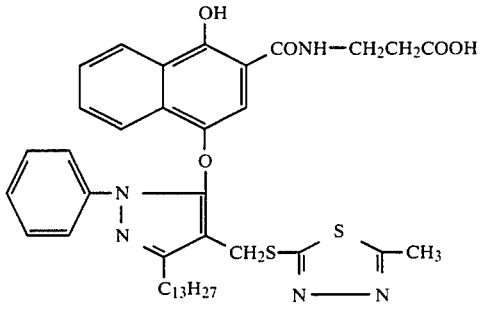
(D-79)
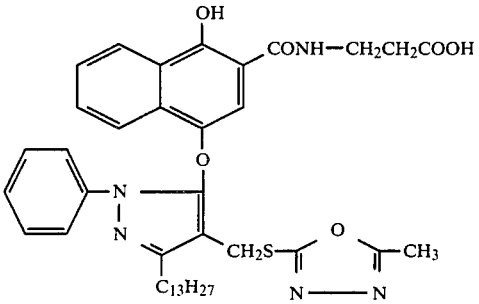
(D-80)
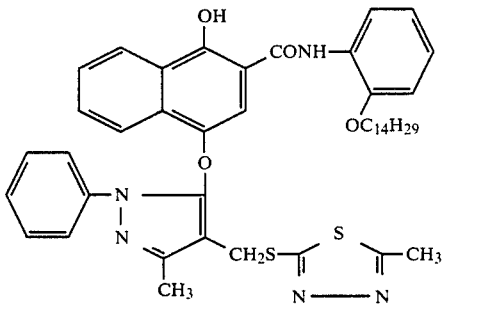

-continued (D-81)

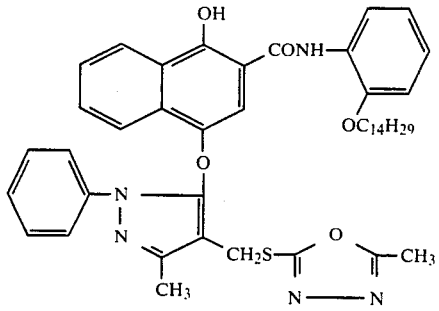

(D-82)

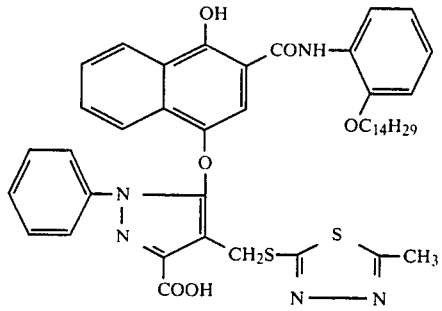

(D-83)

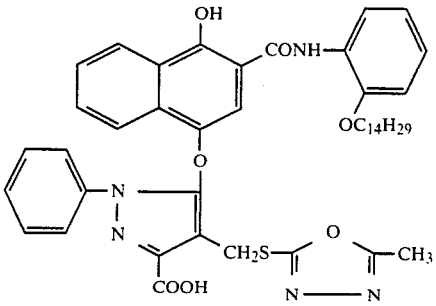

The DIR compounds listed above are preferably incorporated in the light-sensitive silver halide emulsion layers.

Two or more of these DIR compounds may be incorporated in the same layer; alternatively, the same DIR compound may be incorporated in one or more layers.

These DIR compounds are preferably used in amounts of $2\times10^{-4}$ to $5\times10^{-1}$ moles per mole of silver in an emulsion layer, with the range of $1\times10^{-3}$ to $1\times10^{-1}$ being particularly preferred.

Polymer couplers of the type described in Japanese Patent Application No. 172151/1984 may be used in the present invention.

These couplers or DIR compounds may be incorporated in the silver halide emulsions of the present invention, as well as in the coating solutions of other photographic layers, by various techniques. If the couplers or DIR couplers are alkali-soluble, they may be added in the form of alkaline solutions. Oil-soluble couplers or DIR compounds are preferably added to silver halide emulsions or other coating solutions after they are dispersed in fine particles in high-boiling solvents, optionally in combination with low-boiling solvents, in accordance with the methods described in U.S. Pat. Nos. 2,322,027, 2,801,170, 2,801,171, 2,272,191 and 2,304,940. In this case, additives such as hydroquinone derivatives, anti-fading agents and ultraviolet absorbers may also be used together with these couplers and DIR compounds. The couplers may be used either singly or in admixture. One method preferred for used in the invention for the purpose of adding couplers or DIR compounds is hereunder described: one or more of the couplers or DIR compounds are dissolved in high-boiling solvents and/or low-boiling solvents, optionally together with other couplers, hydroquinone derivatives, anti-fading agents or ultraviolet absorbers. Suitable high-boiling solvents are organic acid amides, carbamates, esters, ketones, urea derivatives, ethers and hydrocarbons; particularly preferred examples include di-n-butyl phthalate, tricresyl phosphate, triphenyl phosphate, di-isooctyl azelate, di-n-butyl sebacate, tri-n-hexyl phosphate, N,N-diethylcaprylamidobutyl, N,N-diethyllaurylamide, n-pentadecylphenyl ether, dioctyl phthalate, n-nonylphenol, 3-pentadecylphenyl ethyl ether, 2,5-di-sec-amylphenylbutyl ether, monophenyl-d-o-chlorophenyl phosphate and fluoroparaffin. Suitable low-boiling solvents are methyl acetate, ethyl acetate, propyl acetate, butyl acetate, butyl propionate, cyclohexanol, diethylene glycol monoacetate, nitromethane, carbon tetrachloride, chloroform, cyclohexane tetrahydrofuran, methyl alcohol, acetonitrile, dimethylformamide, dioxane and methyl ethyl ketone. The resulting solution is then mixed with an aqueous solution containing an anionic surfactant and/or a nonionic surfactant and/or gelatin. Suitable anionic surfactants are alkylbenzenesulfonic acid and alkylnaphthalenesulfonic acid. Suitable nonionic surfactants are sorbitan sesquioleate and sorbitan monolaurate. The mixture is agitated in a high-speed mixer, colloid mill or an ultrasonic disperser so as to make a dispersion of the couplers or DIR compounds for incorporation in silver halide emulsions.

Dispersions of the couplers or DIR compounds may also be prepared by the latex dispersion method. Details of this method and the resulting advantages are described in Unexamined Published Japanese Patent Application Nos. 74538/1974, 59943/1976 and 32552/1979; and Research Disclosure, August 1976, No. 14850, pp. 77–79.

Latices suitable for use in this dispersion method are homo-, co- and terpolymers of such monomers as styrene, acrylates n-butyl acrylate, n-butyl methacrylate, 2-acetoacetoxyethyl methacrylate, 2-(methacryloyloxy)ethyltrimethyl ammonium methosulfate, sodium 3-(methacryloyloxy)propane-1-sulfonate, N-isopropylacrylamide, N-[2-[2-methyl-4-oxopentyl)]acrylamide and 2-acrylamido-2-methylpropanesulfonic acid.

The silver halide color photographic material of the present invention may incorporate various other photographic additives, such as anti-color stain agents of the types described in Unexamined Published Japanese Patent Application No. 2128/1971 and U.S. Pat. No. 2,278,659; as well as anti-foggants, stabilizers, ultraviolet absorbers, anti-color stain agents, brighteners, antifading agents, antistats, hardeners, surfactants, plasticizers and wetting agents of the types described in Research Disclosure No. 17643. Various hydrophilic colloids may be used in preparing emulsions for incorporation in the silver halide color photographic material of the invention. Suitable examples are proteins such as gelatin, gelatin derivatives, gelatin to which other polymers are grafted, albumin and casein; cellulose derivatives such as hydroxyethyl cellulose and carboxymethyl cellulose; starch derivatives; and synthetic hydrophilic polymers such as homo- or copolymers of vinyl alcohol, vinylimidazole, acrylamide, etc.

A variety of supports may be used with the silver halide color photographic material of the invention and they include baryta paper, polyethylene-coated paper, synthetic polypropylene paper, transparent supports having a reflective layer or other reflectors, glass plate, polyester films such as those of cellulose acetate, cellulose nitrate and polyethylene terephthalate, polyamide film, polycarbonate film and polystyrene film. A suitable support should be selected depending upon the specific object of the photographic material of the invention.

The silver halide emulsion layers and other photographic layers used in the present invention may be coated by a variety of techniques such as dip coating, air doctor coating, curtain coating and hopper coating. Two or more layers may be coated simultaneously by the method described in U.S. Pat. Nos. 2,761,791 and 2,941,898.

The photographic material using the silver halide emulsions of the present invention may be processed by any of the known methods. Typical processing methods are as follows:

(1) color development, followed by bleach-fixing and optionally by washing and/or stabilization; (2) color development, followed by separate steps of bleaching and fixing, and optionally by washing and/or stabilization; (3) processing consisting, in sequence, of prehardening, neutralization, color development, stop fixation, washing, bleaching, fixation, washing, post-hardening and washing; (4) processing comprising, in sequence, color development, washing, auxiliary color development, stopping, bleaching, fixation, washing and stabilization; and (5) color development followed by the halogenation bleaching of the resulting developed silver, which is subjected to another color development for the purpose of forming an increased amount of dye.

The color developer used in the processing of silver halide emulsions is not critical for the purpose of the present invention, and is usually an aqueous alkaline solution that contains a color developing agent and has a pH of preferably at least 8, more preferably 9–12. An aromatic primary amino developing agent which is typically used as the color developing agent is a compound that has a primary amino group on the aromatic ring and which has the ability to develop exposed silver halide. If necessary, a precursor that forms such compound may also be used.

Typical color developing agents are p-phenylenediamine compounds and the following are preferred: 4-amino-N,N-diethlaniline, 3-methyl-4-amino-N,N-diethylaniline, 4-amino-N-ethyl-N-β-hydroxyethylaniline, 3-methyl-4-amino-N-β-hydroxyethylaniline, 3-methyl-4-amino-N-ethyl-N-β-methoxyethylaniline, 3-methyl-4-amino-N-methyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline; as well as salts thereof such as sulfates, hydrochlorides, sulfites and p-toluenesulfonates.

Other typical examples of color developing agents are those described in Unexamined Published Japanese Patent Application Nos. 64932/1973, 131526/1975 and 95849/1976; and R. L. Bent et al., Journal of the Americal Chemical Society, 73, pp. 3100–3125, 1951.

The amount of these aromatic primary amino compounds used depends on the level at which the activity of the developing solution should be set, and in order to attain higher activities, greater amounts of aromatic primary amino compounds are preferably used. They are generally used in amounts ranging from 0.0002 mol/1,000 ml to 0.7 mol/1,000 ml. Two or more aromatic primary amino compounds may be used to attain specific objects. Illustrative combinations are that of 3-methyl-4-amino-N,N-diethylaniline and 3-methyl-4-amino-N-ethyl-N-β-methanesulfonamidoethylaniline, and that of the 3-methyl-4-amino-N-ethyl-N-β-methanesulfonamidoethylaniline and 3-methyl-4-amino-N-ethyl-N-β-hydroxyethylaniline.

The color developer used in the present invention may also contain a variety of conventional additives such as alkali agents (e.g. sodium hydroxide and sodium carbonate); alkali metal sulfites, alkali metal hydrogensulfites, alkali metal thiocyanates, alkali metal halides, benzyl alcohol, water softeners, thickeners and development accelerators.

Other additives that may be incorporated in the developing solution are bromides such as potassium bromide and ammonium bromide; compounds for rapid processing such as alkali iodide, nitribenzimidazole, mercaptobenzimidazole, 5-methyl-benzotriazole and 1-phenyl-5-mercaptotetrazole; anti-stain agents, anti-sludge agents, preservatives, interimage effect accelerating agents, and chelating agents.

Bleaching agents are used in bleaching baths or bleach-fixing baths and generally known bleaching agents are aminopolycarboxylic acids or organic acids such as oxalic acid and citric acid, which are coordiated to metal ions such as iron, cobalt and copper. Typical aminopolycarboxylic acids are listed below:

ethylenediaminetetraacetic acid;
diethylenetriaminepentaacetic acid;
propylenediaminetetraacetic acid;
nitrilotriacetic acid;
iminodiacetic acid;
ethylether diaminetetraacetic acid;
ethylenediaminetetrapropionic acid;
ethylenediaminetetraacetic acid disodium salt;
diethylenetriaminepentaacetic acid pentasodium salt; and
nitrilotriacetic acid sodium salt.

In addition to the bleaching agents listed above, a variety of additives may be incorporated in the bleaching bath. The bleaching step may be performed with a bleach-fixing bath containing a silver halide fixing agent in addition to any of the bleaching agents mentioned above. The bleach-fixing bath may also contain a halogen compound such as potassium bromide. As in the case of the bleaching bath, the bleach-fixing bath may contain a variety of additives such as pH buffer, antifoaming agent, surfactant, preservative, chelating agent, stabilizing agent and an organic solvent.

Suitable silver halide fixing agents may be sodium thiosulfate, ammonium thiosulfate, potassium thiocyanate, sodium thiocyanate, thiourea, thioether and any other compound that is conventionally used in the fixing step so as to form water-soluble silver salts by reaction with silver halides.

In order to ensure rapid processing, the color development of the silver halide color photographic material of the invention and bleach-fixing thereof (or bleaching and fixing in separate steps), as well as optional steps of washing, stabilization and drying are preferably carried out at temperatures not lower than 30° C.

The silver halide color photographic material of the present invention may be processed by washing replacing stabilization techniques as taught in Unexamined Published Japanese Patent Application Nos. 14834/1983, 105145/1983, 134634/1983 and 18631/1983; and Japanese Patent Application Nos. 2709/1983 and 89288/1984.

As already mentioned, the silver halide color photographic material of the present invention is characterized in that at least a red-sensitive silver halide emulsion layer having high sensitivity is provided between a first green-sensitive silver layer of high sensitivity and a second green-sensitive silver halide layer having a lower sensitivity than said first green-sensitive layer, said first green-sensitive layer and/or said red-sensitive layer with high sensitivity having a maximum color density higher than 0.6 but not exceeding 1.3. This photographic material has high sensitivity and produces an image having an even better quality. The exact reason for this advantageous phenomenon is not completely clear but the following explanation may be proposed. Silver halide color photographic materials are required to have a broad exposure latitude and to provide good sensitivity over the full range of that exposure scale. In order to satisfy these requirements, a layer having sensitivity to light of the same color is generally composed of two or more sub-layers having different sensitivities. With this layer arrangement, it is known effective to limit the proportion of the density provided by the emulsion sub-layer of high sensitivity to a certain level by reducing the concentration of a coupler in that layer. A balance must, therefore, be struck between the granularity of the emulsion sub-layer of high sensitivity and that of the emulsion sub-layer of low sensitivity in order to ensure good granularity over the full range of exposure scale. This balance is closely related to the proportion of the density provided by the emulsion sub-layer of high sensitivity, which in the usual layer arrangement is limited to 0.6 or below since the granularity of the toe region in the characteristic curve of the emulsion sub-layer of high density is appreciably degraded if the proportion of the density provided by that sub-layer exceeds 0.6. However, in accordance with the modified layer arrangement proposed by the present invention, the emulsion sub-layer of high sensitivity is positioned closer to the surface, rather than the support, of the photographic material and this permits the use of finer grained silver halide without impairing the high sensitivity achieved by the usual layer arrangement. In other words, the proportion of the density provided by the emulsion sub-layer of high sensitivity can be increased without causing any appreciable degradation of the granularity of that layer. Therefore, in accordance with the invention, a broad exposure latitude is maintained even if the sensitivity of the emulsion sub-layer of low sensitivity is further decreased by using finer silver halide grains in this layer. As a result, the photographic material of the present invention has an improved granularity over the full range of exposure scale, particularly, in the region having higher densities than the halftone region.

The following examples are provided for further illustrating the claimed photographic material but are not to be construed as limiting the invention. In the examples shown below, the amount of addition in the photographic material is expressed on the basis of square meters. The amounts of silver halide and colloidal silver are expressed in terms of silver.

EXAMPLE 1

Sample No. 1 of the multi-layered color film was prepared by coating the layer arrangement shown in Table 2 on a support subbed with an anti-halation layer. In the following explanation, Pro and BS represent a protective layer and the support, respectively.

Red-sensitive silver halide emulsion layer of low sensitivity, RL-1

This layer contained a dispersion of 1.8 g of Emulsion I spectrally sensitized for red light and 0.5 g of tricresyl phosplate (TCP) in an aqueous solution containing 1.85 g of gelatin. Emulsion I was composed of AgBrI grains having an average size ($\bar{r}$) of 0.61 μm, a coefficient of variation ($s/\bar{r}$) of 0.12 and AgI content of 6 mol%. TCP had dissolved therein 0.2 g of 1-hydroxy-4-(isopropylcarbamoylmethoxy)-N-[δ-(2,4-di-t-amylphenoxy)-butyl]-2-naphthamide (C-1), 0.07 g of 1-hydroxy-4-[4-(1-hydroxy-8-acetamido-3,6-disulfo-2-naphthylazo)-phenoxy]-N-[δ-(2,4-di-t-amylphenoxy)butyl]-2-naphthamide disodium salt (CCi-1), 0.8 g of 1-hydroxy-2-[δ-(2,4-di-t-amylphenoxy)-n-butyl]naphthamide (C-2) and 0.18 g of DIR compound (D-68).

Red-sensitive silver halide emulsion layer of high sensitivity, RH-1

This layer contained a dispersion of 2.0 g of Emulsion II spectrally sensitized for red light and 0.23 g to TCP in an aqueous solution containing 1.2 g of gelatin. Emulsion II was composed of AgBrI grains having an average size of 0.9 μm, a coefficient of variation of 0.30 and AgI content of 6 mol%. TCP had 0.13 g of cyan coupler (C-1) and 0.03 g of colored cyan coupler (CC-1) dissolved therein.

Green-sensitive silver halide emulsion layer of low sensitivity, GL-1

This layer contained a dispersion of 1.5 g of Emulsion I spectrally sensitized to green light and 0.68 g of TCP in an aqueous solution containing 1.4 g of gelatin. TCP contained dissolved therein 0.65 g of 1-(2,4,6-trichlorophenyl)-3-[3-(p-dodecyloxybenzenesulfonamido)benzamido]-5-pyrazolone (M-1), 0.15 g of 1-(2,4,6-trichlorophenyl)-4-(1-naphthylazo)-3-(2-chloro-5-octadecenylsuccinimidoanilino)-5-pyrazolone (CM-1) and 0.03 g of DIR compound (D-1).

Green-sensitive silver halide emulsion layer of high sensitivity, GH-1

This layer contained a dispersion of 2.2 g of Emulsion II spectrally sensitized to green light and 0.27 g of TCP in an aqueous solution containing 1.9 g of gelatin. TCP contained 0.15 g of magenta coupler (M-1) and 0.045 g of colored magenta coupler (CM-1) dissolved therein.

Blue-sensitive silver halide emulsion layer of low sensitivity, BL-1

This layer contained a dispersion of 1.0 g of Emulsion I spectrally sensitized to blue light and 0.68 g of TCP in an aqueous solution containing 1.4 g of gelatin. TCP contained dissolved therein 1.2 g of α-pivaloyl-α-(1-benzyl-2-phenyl-3,5-dioximidazolidin-4-yl)-2-chloro-5-[α-dodecyloxycarbonyl)ethoxycarbonyl]acetanilide (Y-1) and 0.01 g of DIR compound (D-68).

Blue-sensitive silver halide emulsion layer of high sensitivity, BH-1

This layer contained a dispersion of 0.9 g of an emulsion spectrally sensitized to blue light and 0.35 g of TCP in an aqueous solution containing 1.6 g of gelatin. The emulsion was composed of AgBrI grains having an average size of 1.0 μm, a coefficient of variation of 0.14 and AgI content of 8 mol%. TCP had 0.75 g of a yellow coupler (Y-1) dissolved therein.

Intermediate layer, IL

This layer contained 0.8 g of gelatin and 0.07 g of dibutyl phthalate (DBP) having 0.07 g of 2,5-di-t-octylhydroquinone (HQ-1) dissolved therein.

Yellow filter, YF

This layer contained 0.15 g of yellow colloidal silver, 0.11 g of DBP having 0.2 g of anti-color stain agent (HQ-1) dissolved therein, and 1.0 g of gelatin.

Protective layer, Pro

This layer contained 2.3 g of gelatin.

Sample Nos. 2 to 10 were prepared as above except that the layer arrangement was changed to those indicated in Table 2 while the amounts of silver iodobromide grains, couplers C-1 and M-1 present in the high-sensitivity layers and those of silver halide grains in the low-sensitivity layers were changed to those indicated in Table 1.

TABLE 1

| Layer | Average grain size (μm) | Coefficient of variation (%) | Average AgI content (mole %) | Coupler (g) | D max.** |
|---|---|---|---|---|---|
| BH-1 | 1.00 | 14 | 8 | 0.75 | — |
| BH-2 | 1.00 | 14 | 8 | 1.00 | — |
| BL-1 | 0.61 | 12 | 6 | — | — |
| BL-2 | 0.48 | 12 | 6 | — | — |
| GH-1 | 0.90 | 30 | 6 | 0.15 | 0.55 |
| GH-2 | 0.90 | 30 | 6 | 0.18 | 0.65 |
| GH-3 | 0.90 | 30 | 6 | 0.22 | 0.80 |
| GH-4 | 0.90 | 30 | 6 | 0.28 | 1.00 |
| GH-5 | 0.90 | 12 | 6 | 0.34 | 1.20 |
| GH-6 | 0.90 | 30 | 6 | 0.45 | 1.50 |
| GH-7 | 0.85 | 12 | 6 | 0.28 | 1.00 |
| GL-1 | 0.61 | 12 | 6 | — | — |
| GL-2 | 0.53 | 11 | 6 | — | — |
| GL-3 | 0.42 | 9 | 6 | — | — |

TABLE 1-continued

| Layer | Average grain size (μm) | Coefficient of variation (%) | Average AgI content (mole %) | Coupler (g) | D max.** |
|---|---|---|---|---|---|
| GL-4 | 0.31 | 10 | 6 | — | — |
| GL-5 | 0.27 | 11 | 6 | — | — |
| GL-6 | 0.21 | 13 | 6 | — | — |
| RH-1 | 0.90 | 30 | 6 | 0.13 | 0.55 |
| RH-2 | 0.90 | 30 | 6 | 0.16 | 0.65 |
| RH-3 | 0.90 | 30 | 6 | 0.20 | 0.80 |
| RH-4 | 0.90 | 30 | 6 | 0.25 | 1.00 |
| RH-5 | 0.90 | 30 | 6 | 0.31 | 1.20 |
| RH-6 | 0.90 | 12 | 6 | 0.40 | 1.50 |
| RH-7 | 0.85 | 12 | 6 | 0.25 | 1.00 |
| RH-8* | 0.85 | 12 | 6 | 0.25 | 1.00 |
| RL-1 | 0.61 | 12 | 6 | — | — |
| RL-2 | 0.53 | 11 | 6 | — | — |
| RL-3 | 0.42 | 9 | 6 | — | — |
| RL-4 | 0.31 | 10 | 6 | — | — |
| RL-5 | 0.27 | 11 | 6 | — | — |
| RL-6 | 0.21 | 13 | 6 | — | — |

Note: The blanks are the same as in Sample No. 1.

*RH-8 contained equal amounts of C-1 and 1-hydroxy-4-(n-tetradecylcarbamoylmethoxy)-N—(n-butyl)-2-naphthamide as couplers.

**The maximum density of each of the green-sensitive and red-sensitive silver halide emulsion layers was the optical density as measured for samples that had the respective layers coated on a support and which were exposed and developed as sample Nos. 1 to 10 after coating a protective coat (Pro).

TABLE 2

| | Sample No. 1 | 2 | 3 | 4 | 5 | 6 | 7 | 8 | 9 | 10 |
|---|---|---|---|---|---|---|---|---|---|---|
| Layer arrangement | Pro | Pro | Pro | Pro | Pro | Pro | Pro | Pro | Pro | Pro |
| | BH-1 | BH-1 | BH-2 | BH-2 | BH-2 | BH-2 | BH-2 | BH-2 | BH-2 | BH-2 |
| | BL-1 | IL | IL | IL | IL | IL | IL | IL | IL | IL |
| | IL | GH-1 | GH-2 | GH-3 | GH-4 | GH-5 | GH-6 | GH-4 | GH-7 | GH-7 |
| | GH-1 | IL | IL | IL | IL | IL | IL | IL | IL | IL |
| | GL-1 | RH-1 | RH-2 | RH-3 | RH-4 | RH-5 | RH-6 | RH-1 | RH-7 | RH-8 |
| | IL | IL | IL | IL | IL | IL | IL | IL | IL | IL |
| | RH-1 | BL-1 | BL-2 | BL-2 | BL-2 | BL-2 | BL-2 | BL-2 | BL-2 | BL-2 |
| | RL-1 | IL | IL | IL | IL | IL | IL | IL | IL | IL |
| | BS | GL-1 | GL-2 | GL-3 | GL-4 | GL-5 | GL-6 | GL-4 | GL-4 | GL-5 |
| | — | IL | IL | IL | IL | IL | IL | IL | IL | IL |
| | — | RL-1 | RL-2 | RL-3 | RL-4 | RL-5 | RL-6 | RL-1 | RL-4 | RL-6 |
| | — | BS | BS | BS | BS | BS | BS | BS | BS | BS |
| Remarks | Comp. sample | Comp. sample | Sample of the invention | Sample of the invention | Sample of the invention | Sample of the invention | Comp. sample | Sample of the invention | Sample of the invention | Sample of the invention |

Each of the sample Nos. 1 to 10 was exposed to white light through an optical wedge and subsequently processed by the following scheme.

| Steps | Temperature, °C. | Time |
|---|---|---|
| Color development | 38 | 3 min and 15 sec |
| Bleaching | 38 | 6 min and 30 sec |
| Washing | 38 | 3 min and 15 sec |
| Fixing | 38 | 6 min and 30 sec |
| Washing | 38 | 3 min and 15 sec |
| Stabilization | 38 | 1 min and 30 sec |
| Drying | | |

The processing solutions used had the following compositions.

| | |
|---|---|
| Color developer: | |
| 4-Amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Nitrilotriacetic acid trisodium salt | 2.5 g |

-continued

| | |
|---|---|
| (monohydrate) | |
| Potassium hydroxide | 1.0 g |
| Water to make | 1,000 ml |
| Bleaching solution: | |
| Ethylenediaminetetraacetic acid iron ammonium salt | 100.0 g |
| Ethylenediaminetetraacetic acid diammonium salt | 10.0 g |
| Amminium bromide | 150.0 g |
| Glacial acetic acid | 10.0 ml |
| Water to make | 1,000 ml |
| pH adjusted to 6.0 with ammonia water | |
| Fixing solution: | |
| Ammonium thiosulfate | 175.0 g |
| Anhydrous sodium sulfite | 8.5 g |
| Sodium metasulfite | 2.3 g |
| Water to make | 1,000 ml |
| pH adjusted to 6.0 with acetic acid | |
| Stabilizing solution: | |
| Formalin (37% aq. sol.) | 1.5 ml |
| Konidax (Konishiroku Photo Industry Co., Ltd.) | 7.5 ml |
| Water to make | 1,000 ml |

The blue-, green- and red-sensitive layers (B, G and R) in each of the processed samples were checked for their relative sensitivities (S), exposure latitudes (LES) and RMS values. The results are shown in Table 3.

TABLE 3

| | | Sample No. | | | | | | | | | |
|---|---|---|---|---|---|---|---|---|---|---|---|
| | | 1 | 2 | 3 | 4 | 5 | 6 | 7 | 8 | 9 | 10 |
| B | S | 100 | 102 | 104 | 103 | 103 | 104 | 104 | 103 | 102 | 103 |
| | RMS | 35 | 32 | 27 | 27 | 26 | 26 | 26 | 26 | 26 | 26 |
| | LES | 2.6 | 2.7 | 2.8 | 2.8 | 2.8 | 2.8 | 2.8 | 2.8 | 2.8 | 2.8 |
| G | S | 100 | 120 | 120 | 120 | 122 | 123 | 122 | 120 | 120 | 119 |
| | RMS | 27 | 24 | 20 | 17 | 16 | 19 | 25 | 17 | 14 | 14 |
| | LES | 2.1 | 2.3 | 2.6 | 2.7 | 2.9 | 3.0 | 3.1 | 2.8 | 2.9 | 2.9 |
| R | S | 100 | 122 | 125 | 122 | 119 | 121 | 122 | 120 | 121 | 121 |
| | RMS | 28 | 25 | 20 | 17 | 16 | 19 | 25 | 24 | 14 | 12 |
| | LES | 2.0 | 2.2 | 2.6 | 2.7 | 2.8 | 2.9 | 3.1 | 2.8 | 2.8 | 2.8 |

The relative sensitivity (S) is the reciprocal of exposure providing fog plus 0.1, with the value for each of B, G and R in sample No. 1 taken as 100. The broadness of the exposure latitude was expressed in terms of the linear exposure scale (LES) defined in T. H. James, "The Theory of the Photographic Process", 4th ed., Macmillan Publishing Co., pp. 501–502. The RMS value was expressed as 1,000 times the standard deviation of the variations in density that occurred when an image having a density equivalent to Dmin plus 1.2 scanned with a micro-densitometer having a circular scan diameter of 25 μm.

The data in Table 3 clearly shows the high sensitivity of the samples prepared in accordance with the present invention. Sample Nos. 3 to 6 wherein the maximum densities of the red-sensitive silver halide emulsion layer of high sensitivity (RH) and the green-sensitive layer of high sensitivity (GH) were conditioned to be within the range defined by the invention achieved an appreciable improvement in granularity over comparative sample Nos. 1 and 2, and the improvement was particularly significant in Sample Nos. 4 to 6. Sample No. 8 was such that only the maximum density of the green-sensitive silver halide emulsion layer of high sensitivity (GH-5) was controlled to be within the range defined by the invention, but even in this case, the improvement is granularity to green light was noticeable. Greater improvements were observed not only in sample No. 9 using a monodispersed emulsion in each of the high-sensitivity emulsion layers, but also in sample No. 10 wherein the red-sensitive silver halide emulsion layer of high sensitivity (RH) contained a monodispersed emulsion and a coupler that would form a slightly diffusible dye upon color development.

Sample Nos. 3 to 6, and 8 to 10 had high LES values, hence broad exposure latitudes. The layers in each of the samples were progressively removed by a protease containing solution and the green- and red-sensitive layers of high sensitivity were found to have maximum color densities which were in agreement with the values shown in Table 1. No exact data were obtained for RH-8 in sample No. 10 since the dye ran off during analysis.

EXAMPLE 2

Sample Nos. 11 to 17 were prepared using the layer arrangements shown in Table 5 and by repeating the procedure used to prepare sample No. 1 in Example 1 except that the content of silver iodobromide grains and the amount the coupler present in the red-sensitive silver halide emulsion layer of high sensitivity (RH) were changed to the values shown in Table 4. The red-sensitive silver halide emulsion of medium sensitivity (RM) and the green-sensitive silver halide emulsion of medium sensitivity (GM) were prepared by methods which were substantially the same as those used in preparing GL-1 and RL-1, respectively, in Example 1.

The samples were processed as in Example 1 and the results are shown in Table 6.

TABLE 4

| Layer | Average grain size (μm) | Coefficient of variation | Average AgI content (mol %) | Coupler (g) | D max. |
|---|---|---|---|---|---|
| BH-11 | 1.40 | 12 | 8 | — | — |
| BL-11 | 0.70 | 11 | 8 | — | — |
| GH-11 | 1.30 | 30 | 6 | 0.15 | 0.55 |
| GL-11 | 0.72 | 12 | 6 | — | — |
| RH-11 | 1.30 | 30 | 6 | 0.14 | 0.55 |
| RH-12 | 1.30 | 30 | 6 | 0.22 | 0.80 |
| RH-13 | 1.30 | 30 | 6 | 0.27 | 1.00 |
| RM-14 | 1.20 | 12 | 6 | 0.27 | 1.00 |
| RL-11 | 1.72 | 12 | 6 | — | — |
| RL-12 | 0.35 | 13 | 6 | — | — |
| RL-13 | 0.48 | 12 | 6 | — | — |
| RL-14 | 0.35 | 13 | 6 | — | — |
| RL-15 | — | — | 6 | — | — |
| RM-11 | 0.72 | 12 | 6 | — | — |
| RM-12 | 0.72 | 12 | 6 | — | — |
| GM-11 | 0.72 | 12 | 6 | — | — |
| GM-12 | 0.35 | 13 | 6 | — | — |

TABLE 5

| | Sample No. | | | | | | |
|---|---|---|---|---|---|---|---|
| | 11 | 12 | 13 | 14 | 15 | 16 | 17 |
| Layer arrangement | Pro | Pro | Pro | Pro | Pro | Pro | Pro |
| | BH-11 | BH-11 | BH-11 | BH-11 | BH-11 | BH-11 | BH-11 |
| | BL-11 | BL-11 | BL-11 | BL-11 | BL-11 | BL-11 | BL-11 |
| | YF | YF | YF | YF | YF | YF | YF |
| | GH-11 | GH-11 | GH-11 | GH-11 | GH-11 | GH-11 | GH-11 |
| | GL-11 | RH-11 | RH-11 | RH-12 | RH-13 | RH-14 | RH-13 |
| | IL | IL | IL | IL | IL | IL | IL |
| | RH-11 | GL-11 | GM-11 | GL-11 | GL-11 | GL-11 | GM-11 |
| | RL-11 | RL-11 | GL-12 | RL-13 | RL-14 | RL-14 | GL-12 |
| | BS | BS | IL | BS | BS | BS | IL |
| | — | — | RM-11 | — | — | — | RM-12 |
| | — | — | RL-12 | — | — | — | RL-12 |
| | — | — | BS | — | — | — | BS |
| Remarks | Comparative Sample | Comparative Sample | Comparative Sample | Sample of the invention | Sample of the invention | Sample of the invention | Sample of the invention |

TABLE 6

| | Sample No. | | | | | | |
|---|---|---|---|---|---|---|---|
| | 11 | 12 | 13 | 14 | 15 | 16 | 17 |
| S | 100 | 101 | 102 | 102 | 101 | 102 | 103 |
| RMS | 60 | 61 | 62 | 60 | 60 | 61 | 62 |
| LES | 2.5 | 2.6 | 2.6 | 2.7 | 2.6 | 2.5 | 2.6 |
| S | 100 | 101 | 102 | 101 | 103 | 103 | 105 |
| RMS | 42 | 43 | 42 | 43 | 42 | 42 | 43 |
| LES | 2.0 | 2.2 | 2.2 | 2.2 | 2.1 | 2.2 | 2.1 |
| S | 100 | 120 | 122 | 123 | 123 | 122 | 125 |
| RMS | 42 | 39 | 38 | 33 | 31 | 28 | 27 |
| LES | 2.0 | 2.1 | 2.4 | 2.7 | 2.8 | 2.8 | 3.0 |

As Table 6 shows, sample Nos. 14 to 17 wherein the maximum density of the green-sensitive silver halide emulsion layer of high sensitivity (GH) was conditioned to be within the range defined by the invention had significantly improved levels of granularity and, hence, produced images of higher quality than those produced in comparative sample Nos. 11 to 13. Sample Nos. 14 to 17 also had high LES values, hence broad exposure latitudes. The layers in each of the samples were progressively removed by a protease containing solution and the green- and red-sensitive layers of high sensitivity were found to have maximum color densities which were in agreement with the values shown in Table 6.

What is claimed is:

1. A silver halide color photographic material having blue-, green- and red-sensitive silver halide emulsion layers coated on a support, each layer being composed of a plurality of sub-layers having different sensitivities, wherein at least a red-sensitive silver halide emulsion sub-layer having high sensitivity is provided between a first green-sensitive silver halide emulsion sub-layer of high sensitivity and a second green-sensitive silver halide emulsion sub-layer having a lower sensitivity than said first green-sensitive sub-layer, the grains in said first green-sensitive sub-layer and/or said red-sensitive sub-layer with high sensitivity being monodispersed and at least one of said first green-sensitive sub-layer and said red-sensitive sub-layer having a maximum color density of formed dye in said material higher than 0.6 but not exceeding 1.3.

2. A silver halide color photographic material according to claim 1, wherein said maximum color density of formed dye is from 0.7 to 1.2.

3. A silver halide color photographic material according to claim 1, wherein said maximum color density of formed dye is from 0.8 to 1.1.

4. A silver halide color photographic material according to claim 1, wherein on said support, a red-sensitive silver halide emulsion sub-layer having lower sensitivity, a green-sensitive silver halide emulsion sub-layer having lower sensitivity and a blue-sensitive silver halide emulsion sub-layer having lower sensitivity are provided in sequence, and further on said sub-layers, a red-sensitive silver halide emulsion sub-layer having high sensitivity, a green-sensitive silver halide emulsion sub-layer having high sensitivity and a blue-sensitive silver halide emulsion sub-layer having high sensitivity are provided in sequence.

5. A silver halide color photographic material according to claim 1, wherein each of said blue-, green- and red-sensitive silver halide emulsion layers comprises a silver halide emulsion sub-layer having high sensitivity and a silver halide emulsion sub-layer having lower sensitivity.

6. A silver halide color photographic material according to claim 1, wherein said grains in the first green-sensitive sub-layer and/or the red-sensitive sub-layer with the high sensitivity have such a size distribution that the standard deviation of size distribution (s) as divided by the mean particle size (r) is 0.20 or below.

* * * * *